US010060054B2

(12) United States Patent
Weening et al.

(10) Patent No.: US 10,060,054 B2
(45) Date of Patent: Aug. 28, 2018

(54) UNITARY WOVEN FABRIC CONSTRUCT OF MULTIPLE ZONES

(71) Applicant: The North Face Apparel Corp., Wilmington, DE (US)

(72) Inventors: Dheen Weening, San Francisco, CA (US); Andrew Yip, Alexandria, VA (US); Allie Pettitt, Portland, OR (US); Sunshine Uy, Oakland, CA (US)

(73) Assignee: The North Face Apparel Corp., Wilmington, DE (US)

( * ) Notice: Subject to any disclaimer, the term of this patent is extended or adjusted under 35 U.S.C. 154(b) by 0 days.

(21) Appl. No.: 15/310,005

(22) PCT Filed: Apr. 28, 2015

(86) PCT No.: PCT/US2015/027975
§ 371 (c)(1),
(2) Date: Nov. 9, 2016

(87) PCT Pub. No.: WO2015/171363
PCT Pub. Date: Nov. 12, 2015

(65) Prior Publication Data

US 2017/0233904 A1 Aug. 17, 2017

Related U.S. Application Data

(60) Provisional application No. 61/991,293, filed on May 9, 2014.

(51) Int. Cl.
*A41D 31/00* (2006.01)
*D03D 15/08* (2006.01)
(Continued)

(52) U.S. Cl.
CPC ..... *D03D 13/00* (2013.01); *A41D 31/00* (2013.01); *D03D 13/004* (2013.01);
(Continued)

(58) Field of Classification Search
CPC ..... A41D 2400/10; A41D 13/0015; A41D 13/002; A41D 27/28; A41D 2400/22;
(Continued)

(56) References Cited

U.S. PATENT DOCUMENTS 4,485,535 A 12/1984 Oishi
4,635,301 A * 1/1987 Sulser ..... A41B 1/00 2/105
(Continued)

FOREIGN PATENT DOCUMENTS

CA 2510558 7/2004
CN 101573485 11/2009
(Continued)

OTHER PUBLICATIONS

Harada et al. XP002715732—Textile for clothing such as bodysuit, girdle, leotard, shorts, brassiere, leggings, tights for sports, innerwear for sports, socks and swimming suits, has preset permeability and textile strength of high permeability region. Retrieved Jan. 23, 2014, vol. 2008, Nr: 64, 2008-K75058.
(Continued)

*Primary Examiner* — Bobby Muromoto, Jr.
(74) *Attorney, Agent, or Firm* — Ganz Pollard, LLC

(57) ABSTRACT

A fabric construct consists of a woven fabric of weft and warp yarns, and the fabric has an area defined by plurality of zones consisting of at least one zone of a first zone type, optionally, at least one zone of a second zone type; and at least one zone of a third zone type. The third zone is a transition zone disposed adjacent the first and/or second zones. All the zones are formed in a unitary woven construct, with adjacent zones seamlessly joined together. The transition zone includes a plurality of bands of sets of weft and/or warp yarns that collectively provide a progressive transition for an attribute of the first zone type through at least the
(Continued)

transition zone and to the second zone type, if present. The fabric construct may be used in various end products and is particularly suited for use in apparel applications.

41 Claims, 11 Drawing Sheets

(51) Int. Cl.
*D03D 13/00* (2006.01)
*D03D 15/12* (2006.01)
*D03D 15/00* (2006.01)
*A41D 27/00* (2006.01)

(52) U.S. Cl.
CPC ..... *D03D 13/008* (2013.01); *D03D 15/00* (2013.01); *D03D 15/12* (2013.01); *D10B 2501/04* (2013.01); *D10B 2501/043* (2013.01); *D10B 2505/18* (2013.01)

(58) Field of Classification Search
CPC ..... A41D 13/0017; A41D 2400/60; A41D 31/00; A41D 31/0011; A41D 31/0033; A41D 31/0038; A41D 13/0012; D03D 13/004; D03D 15/08; D03D 13/008; D03D 15/00; D03D 39/16; D03D 13/00; D03D 3/02; D03D 15/04; D03D 27/06; D03D 11/00; D03D 1/00
See application file for complete search history.

(56) References Cited

U.S. PATENT DOCUMENTS 4,649,573 A * 3/1987 Yen ..... A41D 1/02 2/108
5,604,997 A * 2/1997 Dieter ..... A43B 23/042 12/146 C
5,692,319 A 12/1997 Parker et al.
6,000,442 A * 12/1999 Busgen ..... D03D 3/08 139/100
6,029,376 A 2/2000 Cass
6,047,406 A * 4/2000 Dicker ..... A41D 13/0015 2/115
6,299,962 B1 10/2001 Davis et al.
6,367,168 B1 4/2002 Hatfield et al.
6,401,497 B1 * 6/2002 Nishiyama ..... A41B 9/04 66/171
6,584,707 B1 7/2003 Racine
6,837,274 B2 * 1/2005 Debaes ..... D03D 27/10 139/102
7,435,264 B2 10/2008 Kanatani et al.
7,437,774 B2 * 10/2008 Baron ..... A41D 1/04 2/115
7,568,298 B2 * 8/2009 Kerns ..... A43B 1/04 2/96
7,637,032 B2 * 12/2009 Sokolowski ..... A43B 1/04 36/3 A
7,836,917 B1 11/2010 Osborne
7,836,918 B1 * 11/2010 Osborne ..... D03D 15/08 139/11
7,841,369 B1 * 11/2010 Osborne ..... A41D 13/0012 139/319
8,333,221 B2 * 12/2012 Ly ..... B32B 5/10 139/383 R
8,814,429 B2 8/2014 Roether et al.
2002/0066211 A1 6/2002 Hatfield et al.
2003/0111127 A1 6/2003 Kikuchi
2004/0087366 A1 5/2004 Shum et al.
2004/0118018 A1 6/2004 Dua
2005/0016023 A1 1/2005 Burris et al.
2005/0037844 A1 4/2005 Shum et al.
2005/0204449 A1 * 9/2005 Baron ..... A41D 1/04 2/69
2005/0268497 A1 12/2005 Alfaro et al.
2005/0284002 A1 12/2005 Aveni
2006/0059715 A1 3/2006 Aveni
2006/0101674 A1 5/2006 Ungari
2006/0117600 A1 6/2006 Greene
2006/0179539 A1 * 8/2006 Harber ..... A41D 13/002 2/69
2006/0277950 A1 * 12/2006 Rock ..... A41D 13/002 66/169 R
2007/0033836 A1 2/2007 Rasmussen
2007/0068047 A1 3/2007 Alfaro et al.
2008/0005933 A1 1/2008 Auger et al.
2008/0010863 A1 1/2008 Auger et al.
2008/0083137 A1 4/2008 Aveni
2008/0148600 A1 6/2008 Aveni et al.
2008/0268217 A1 10/2008 Kanatani et al.
2009/0053950 A1 2/2009 Surve
2009/0068908 A1 3/2009 Hinchcliff
2009/0071041 A1 3/2009 Hooper
2009/0126823 A1 * 5/2009 Yengkhom ..... D03D 3/02 139/450
2010/0107442 A1 5/2010 Hope et al.
2010/0199406 A1 8/2010 Dua et al.
2010/0199520 A1 8/2010 Dua et al.
2011/0023327 A1 2/2011 Auger et al.
2011/0045730 A1 2/2011 Surve
2011/0070412 A1 * 3/2011 Ly ..... B32B 5/10 428/196
2011/0302804 A1 12/2011 Hooper
2011/0302806 A1 12/2011 Auger et al.
2012/0017481 A1 1/2012 Settles et al.
2012/0037263 A1 * 2/2012 Malloy ..... D03D 3/00 139/387 R
2012/0246973 A1 10/2012 Dua
2013/0019987 A1 * 1/2013 Beauduin ..... D03D 27/06 139/21
2013/0031811 A1 2/2013 Spanks et al.
2013/0047467 A1 2/2013 Roether et al.
2013/0051706 A1 2/2013 Roether et al.
2013/0051712 A1 2/2013 Roether et al.
2013/0067639 A1 3/2013 Dua et al.
2013/0067768 A1 3/2013 Dua et al.
2013/0068378 A1 3/2013 Dua et al.
2013/0069266 A1 3/2013 Dua et al.
2013/0139412 A1 6/2013 Auger et al.
2013/0186506 A1 7/2013 Cross et al.
2013/0189890 A1 7/2013 Cross et al.
2013/0190917 A1 7/2013 Cross et al.
2013/0196100 A1 8/2013 Cross et al.
2013/0217288 A1 * 8/2013 Martin ..... D03D 13/004 442/203
2013/0260104 A1 10/2013 Dua et al.
2013/0318726 A1 12/2013 Hooper et al.
2014/0237854 A1 8/2014 Fallon
2014/0260677 A1 9/2014 Dojan et al.
2017/0029989 A1 * 2/2017 Tuscia ..... D04B 1/16

FOREIGN PATENT DOCUMENTS

CN 102630259 A 8/2012
EP 1091030 A1 4/2001
EP 2039403 3/2009
EP 2397594 12/2011
EP 2407302 1/2012
EP 2453048 5/2012
EP 2478139 A2 7/2012
EP 2397320 12/2012
FR 2095158 A5 2/1972
FR 2847127 A1 5/2004
GB 258559 A 3/1927
JP S52-25164 2/1977
JP S57-143564 A 9/1982
JP H06-057584 A 3/1994
JP 2000345446 12/2000
JP 2005087611 A 4/2005
JP 2008121157 A 5/2008
TW M452973 5/2013
WO 2004041379 3/2004

(56) References Cited

FOREIGN PATENT DOCUMENTS

| | | | |
|---|---|---|---|
| WO | 2004093586 | | 11/2004 |
| WO | 2005102483 | | 11/2005 |
| WO | 2005120274 | | 12/2005 |
| WO | 2006063018 | | 6/2006 |
| WO | 2008011366 | | 1/2008 |
| WO | 2008099830 | A1 | 8/2008 |
| WO | 2010054047 | | 5/2010 |
| WO | 2010090923 | | 8/2010 |
| WO | 2011034683 | A2 | 3/2011 |
| WO | 2011046762 | | 4/2011 |
| WO | 2012138488 | | 10/2012 |
| WO | 2002100200 | A2 | 12/2012 |
| WO | 2013019481 | | 2/2013 |
| WO | 2013033408 | | 3/2013 |
| WO | 2013085720 | | 6/2013 |
| WO | 2013112992 | | 8/2013 |
| WO | 2013148244 | A1 | 10/2013 |
| WO | 2014100819 | | 6/2014 |
| WO | 2014100820 | | 6/2014 |
| WO | 2014100821 | | 6/2014 |
| WO | 2014113354 | | 7/2014 |
| WO | 2014151674 | | 9/2014 |

OTHER PUBLICATIONS

ISA/KIPO, International Search Report and Written Opinion for PCT Application No. PCT/US2010/046164, dated Apr. 27, 2011.

Regenold, Stephen, Future Gear! Peek Inside The North Face Products Lab, Gear Junkie Gear Review, Oct. 24, 2013, (http://gearjunkie.com/future-gear-the-north-face).

Glenn, Megan, Two Performance Properties Woven into One Fabric, Outdoor USA Magazine, Feb. 2014.

ISR/US, International Search Report and Written Opinion for PCT Application No. PCT/US2015/027975, dated Aug. 19, 2015.

WIPO, International Preliminary Report on Patentability for PCT Application No. PCT/US2015/027975, dated Nov. 24, 2016.

Taiwan Office Action for Taiwan Patent Application No. 104114387 dated Nov. 29, 2016.

First Office Action and Search Report with English Translation in Chinese Application No. 201580037345.7, dated Sep. 19, 2017, 13 pages.

Extended European Search report for European application No. 15788884.3 dated Jan. 3, 2018, 9 pages.

Office Action with English Translation for Japanese application No. dated Jan. 23, 2018, 9 pages.

Office Action, with English Translation issued in Korean Application No. 10-2016-7034397, dated Apr. 17, 2018, 10 pages.

* cited by examiner (Enlargement of area encircled in Fig. 2, labeled 3-3)

Weft Yarn Type $Y_1$ = Blue $Y_2$ = Red

Warp Yarn Type $Y_3$ = Green (Backside outer surface of Jacket 200)

(16a-16c go to black dots)

200

(Backside inner surface of Jacket 200)

(16d-16e go to white dots)

300

300

UNITARY WOVEN FABRIC CONSTRUCT OF MULTIPLE ZONES

RELATED APPLICATIONS

This application claims the benefit of and priority to U.S. Provisional Application Ser. No. 61/991,293, filed May 9, 2014, the contents of which are hereby incorporated by reference as if recited in full herein for all purposes.

BACKGROUND

The inventive subject matter generally is directed to woven constructions of fabric that are used in various end products but are particularly suited for use in apparel applications. More particularly the inventive subject matter is directed to fabric constructs that have multiple functional and/or visual effects zones that are formed in a unitary woven fabric construct where the different zones are seamlessly joined. The inventive subject matter is also directed to methods of making the fabric constructs and end products.

It is often desirable to have different functional attributes in different areas of a product. For example, in fabric-based products, the attributes may be selected to create special zones of durability; relatively high porosity for venting or breathability; elasticity for conforming to a person or thing's shape or accommodating movement; waterproofness; thermal insulation or retention; fire retardancy, etc. Often these various functional attributes create conflict in the choice of weaving materials and processes. For example, the objective of durability may be at the cost of breathability or elasticity.

Disadvantageously, conventional approaches to producing apparel items, or other end products, with multiple zones of specific attributes require panelization of the product according to specific zones. Each panel is a separate component that must be seamed to another panel to create the overall product. This results in significant disadvantages in terms of cost, time, product reliability, and otherwise. For example, each panel may need to be run on a different weaving machine or in different batch operation on the same machine.

There have been some improvements in the art that teach the use of unitary woven constructs with zones of different attributes. For example, U.S. Pat. No. 8,333,221, which is under common ownership with the present application, discloses certain forms of unitary woven fabrics with multiple functional zones based on a limited set of disclosed attribute types. However, such conventional art still has certain drawbacks. For example, in both the conventional panelized woven constructions and the unitary woven constructions, the adjacent zones have discretely different sets of attributes and there is an abrupt transition from one zone to another or limited control over the nature of a transition, for instance, the '221 patent discloses variation in the spacing of rows of yarns, but this approach is limited and inflexible as a form of customizing a transition. Further, the visual appearance of such products can be aesthetically unpleasing because of abrupt transitioning between zones and the use of excessive seams. Thus, in some cases, the conventional art takes an all or nothing approach to mapping the different zones to corresponding areas of need in an end product—it assumes a given zone needs all of one set of attributes or all of another set. In other words, each overall zone represents a uniform set of attributes. In other cases, there is no flexibility in how transitioning occurs, only a limited, spacing-dependent effect.

Conventional fabric constructs have not adequately solved the challenge of providing smooth or progressive transition from one zone of attributes to another zone of attributes in a unitary woven fabric. In short, conventional fabric constructs and methods have not adequately solved the challenge of providing a diverse range of attributes in a unitary woven fabric. Conventional fabric constructs and methods have not adequately solved the challenge of providing smooth or progressive transition from one zone of attributes to another zone of attributes in a unitary woven fabric. Accordingly, there is a significant need for new and improved constructs and methods that address the foregoing and other unmentioned disadvantages in the prior art.

SUMMARY

The inventive subject matter generally relates to certain novel unitary woven fabric constructs that may be used in engineered items of apparel, or other end products, which have different areas providing desired differences for functional and/or visual effects attributes.

In one possible embodiment, the inventive subject matter is directed to a fabric construct consisting of a woven fabric of weft and warp yarns. The fabric has an area defined by a plurality of zones comprising at least one zone of a first zone type, and at least one zone of a second zone type. The second zone is a transition zone disposed adjacent or closely proximate the first zone. All the zones being formed as a unitary woven construct with the zones seamlessly joined together. The transition zone comprises a plurality of bands of sets of weft and/or warp yarns that collectively provide a progressive transition of the selected attribute from first zone type through the transition zone. An article of apparel or other end product may be made using the fabric construct.

In certain embodiments, the inventive subject matter is directed to a fabric construct that consists of a woven fabric of weft and warp yarns, and the fabric has an area defined by a plurality of zones consisting of at least one zone of a first zone type, at least one zone of a second zone type; and at least one zone of a third zone type. The third zone is a transition zone disposed between the first and second zones. All the zones are formed in a unitary woven construct, with adjacent zones seamlessly joined together. The transition zone includes a plurality of bands of sets of weft and/or warp yarns that collectively provide a progressive transition for the attribute for the first zone type to the second zone type.

As used herein, a reference to an "attribute" means a property of an object. (It is to be understood herein that in discussing transitions of an attribute from one zone to another, what is meant is a change in value or other measure for a given attribute, not a change in the kind of attribute being discussed.)

The fabric construct may be used in various end products and is particularly suited for use in apparel applications. In such applications, there may be a mapping of a pattern of an apparel item to the fabric construct so that the zones in the fabric each map to different at areas on the apparel item, which each provide a difference for a selected functional and/or visual effects attribute. Each zone in the fabric construct may be distributed to two or more separate areas on the apparel item. Each area provides a difference for a selected functional and/or visual effects attribute.

In certain embodiments, a progressive transition of attributes may be created by selectively floating yarns in the weave of the fabric construct. As an example, yarns may be selectively floated in successive rows to define a pattern of discrete shapes that progressively change across the transition zone and thereby define the progressive transition of attributes in a transition zone, at least in part. The pattern may be a pixelated pattern with progressive change in pixel size, shape and/or spacing. Each pixel is determined by a set of warp and weft yarn crossovers that are contiguous and discrete and spaced from other sets of crossovers.

The appended claims, as originally filed in this document, or as subsequently amended, are hereby incorporated into this Summary section as if written directly in. The foregoing summary and the appended claims are not intended to be an exhaustive list of embodiments and features of the inventive subject matter. Persons skilled in the art are capable of appreciating other embodiments and features from the following detailed description in conjunction with the drawings.

BRIEF DESCRIPTION OF THE DRAWINGS

The figures show embodiments according to the inventive subject matter, unless noted as showing prior art.

DETAILED DESCRIPTION

Figure 1:
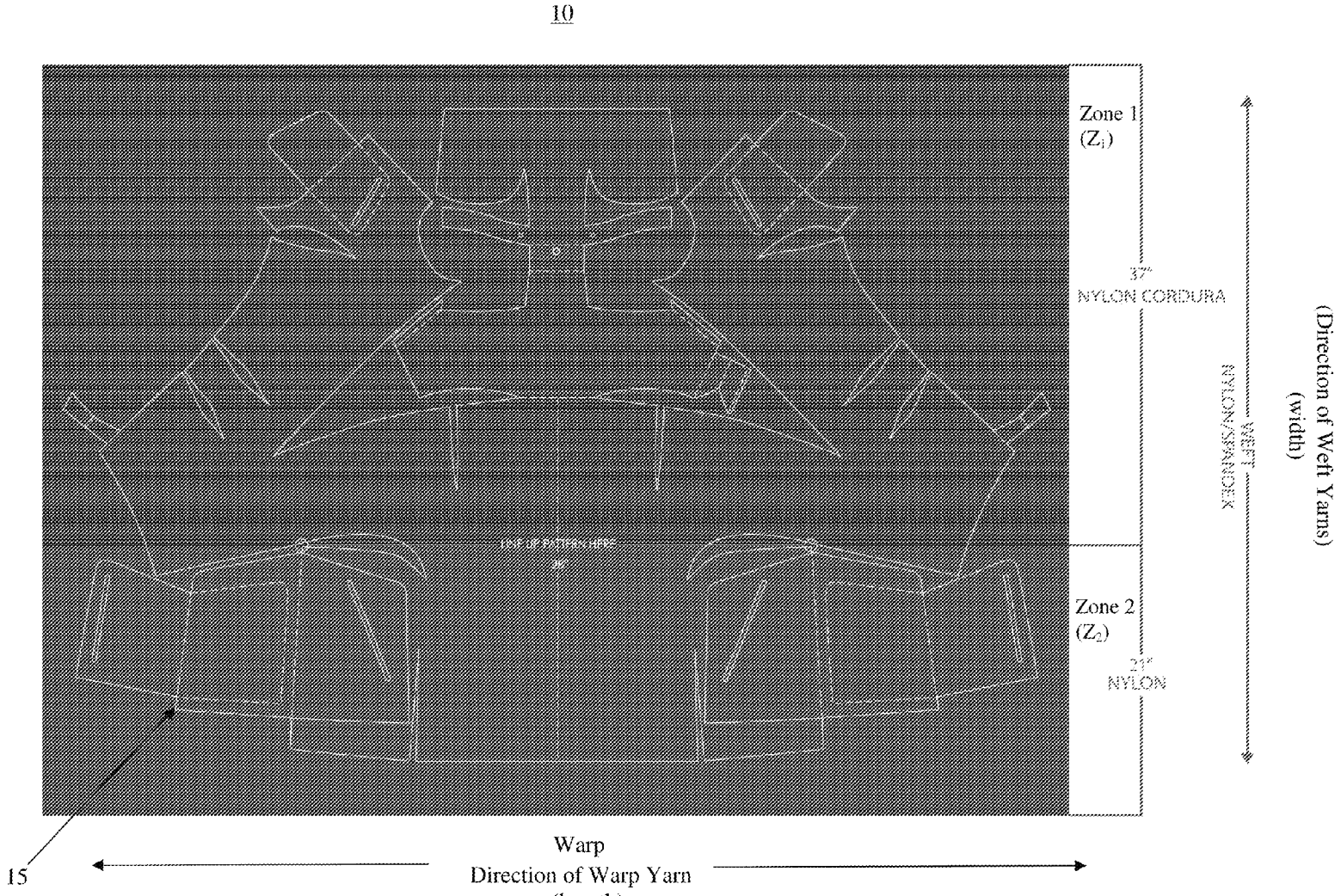
FIG. 1 shows a textile with multiple zones, all in a unitary woven, seamless construction, an outline in the nature of a pattern for a garment being disposed over the textile.
Figure 2A:
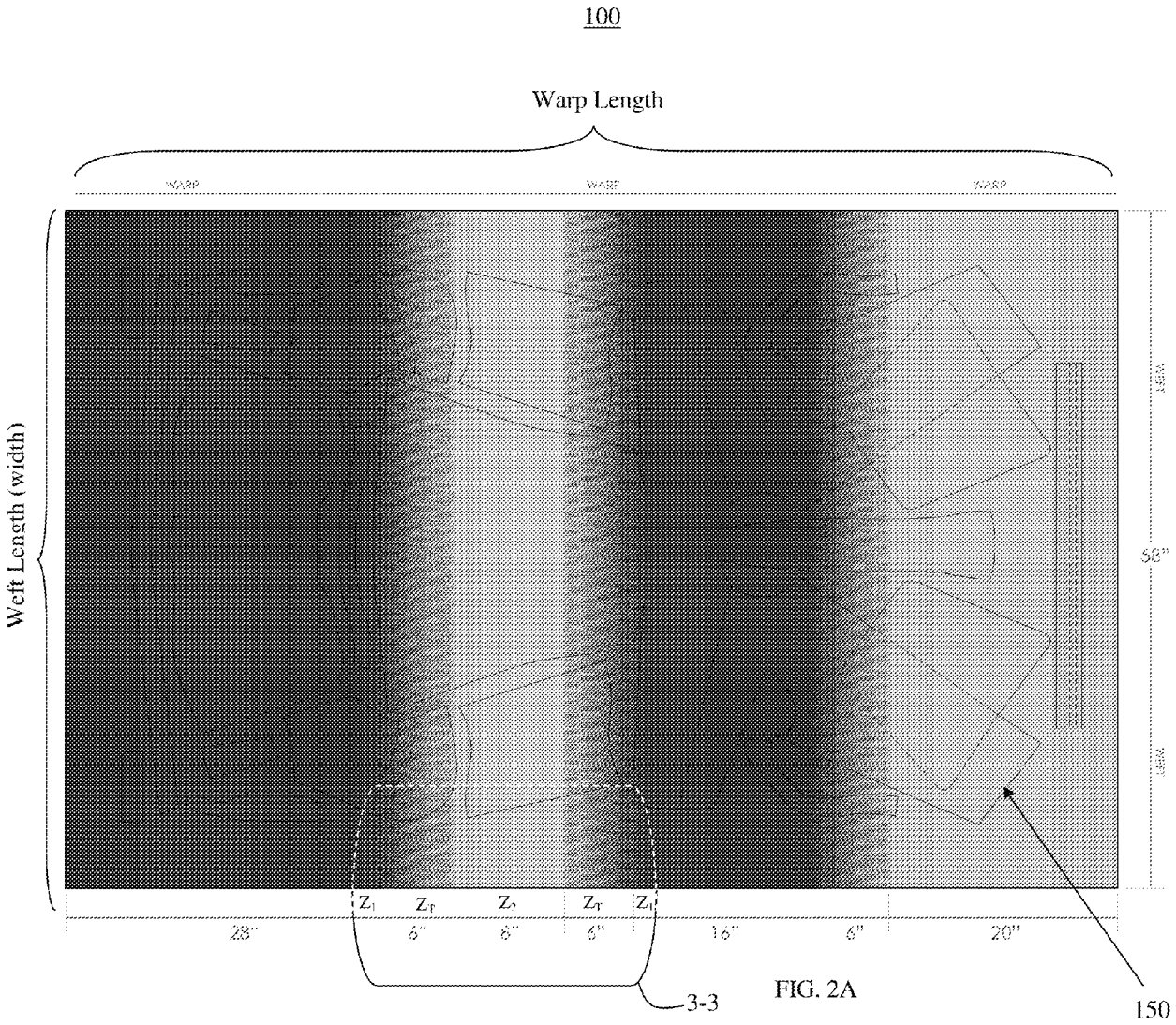
FIG. 2A shows an alternative embodiment of a textile with multiple zones, some of which are transition zones, all in a unitary woven, seamless construction, an outline in the nature of a pattern for a garment being disposed over the textile.
Figure 2B:
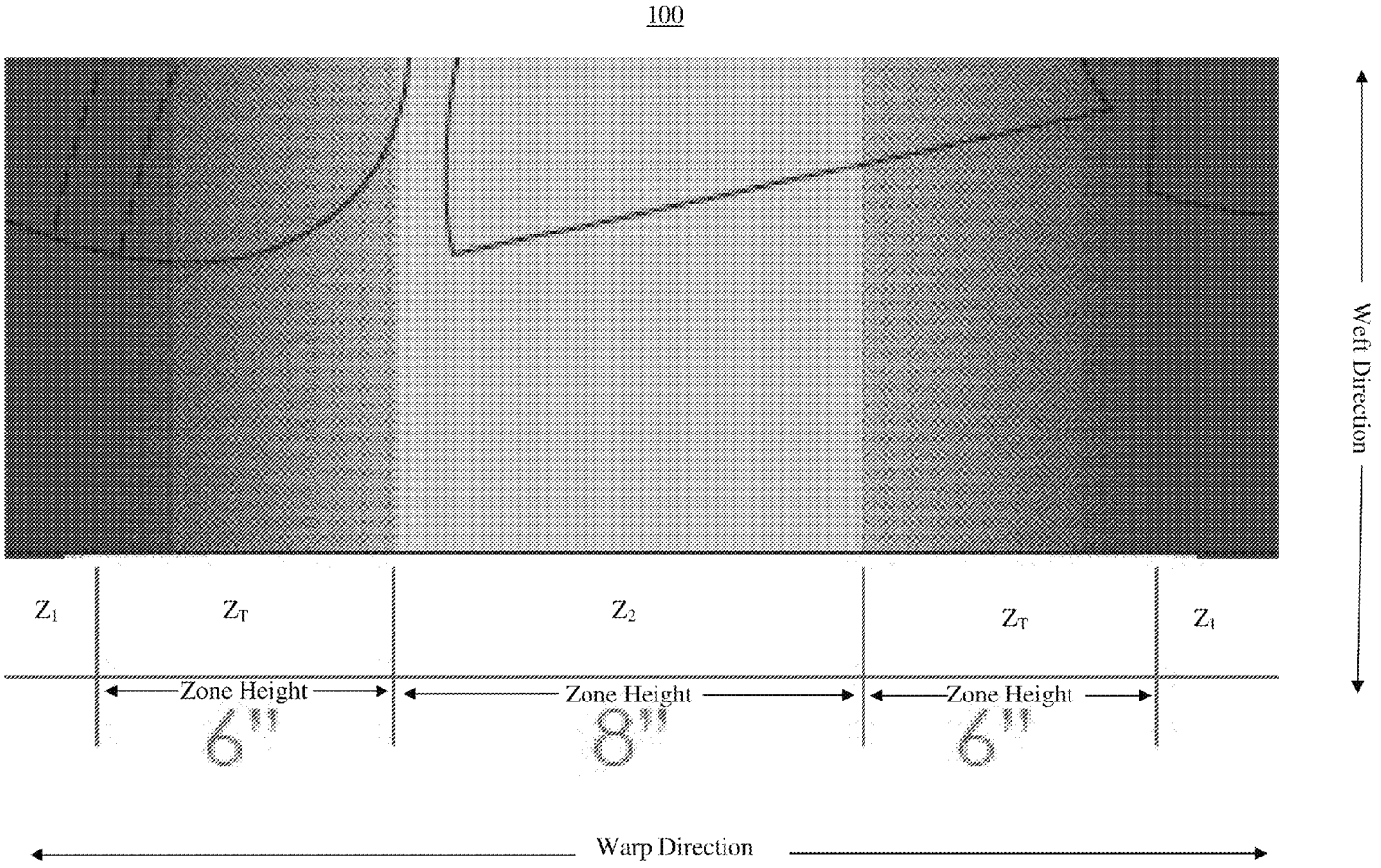
FIG. 2B shows an enlargement of the encircled area on FIG. 2A labeled 3-3.

Representative embodiments according to the inventive subject matter are shown in FIGS. 1-7, wherein the same or generally similar features share common reference numerals.

Multiple Zones with Transition Zones

The inventive subject matter is generally directed to a woven fabric with multiple zone types that differ from one another and correspond to differing functional needs in a garment or other woven object.

Figures show a weaving scheme where multiple zones are woven to correspond to a product pattern, namely a jacket. Functional zones of a given weaving type may be for one or more of the following attributes:

- Durability (as measured by strength and/or durability)
- Breathability (permeability)
- Elasticity (for example, to provide good fit, stretchability, performance zones)
- Comfort (hand)
- Insulation
- Waterproofness
- Flame retardancy
- Visual effects (e.g., colors, patterns, surface textures)
- Etc.

Zones may vary based on:

- Types of yarns used
- Denier of yarns
- Weave attributes including type of weave, or number and or spatial relationships of yarns in a given weave, e.g., fabric count.

Accordingly, the inventive subject matter contemplates at least a first zone type ($Z_1$) and a second zone type ($Z_2$) that differ in one or more attributes. (See FIG. 1.) In between the first and second zone types may be a third zone type that is adjacent to each but different from the first and second zones. (See FIG. 2.) In some embodiments, for attributes that are numerically measurable, a comparison of a given attribute used in one zone type compared with a another zone type shows at least a 10%, 20%, 30%, 40%, 50%, 60%, 70%, 80%, 90%, 100%, 125%, 150%, 200%, 250%, 300%, 400%, 500%, 600%, 700% 800%, 900%, 1000%, 5000%, 10,000% or greater relative difference.

Under the inventive subject matter, the third zone type may be a transition zone ($Z_T$) that has a selected blend of one or more attributes of the first and second zone types that are adjacent or closely spaced to a transition zone. The transition zone is part of a unitary, seamless weave with two or more adjacent zones of different types. The transition zone may provide a progressive transition of some or all attributes of one adjacent zone type to one or more other different adjacent zone types. Typically, the transition zone is spaced in between and separates—in whole or part—two different zone types that are adjacent the transition zone. Most typically, as seen in the Figures, the different zone types are adjacent to the transition zone and on opposite sides of it.

Apart from transition zones, other zone types that are adjacent or closely proximate a given transition zone may have one or more selected attributes that remain uniform or constant across the zone. Transition zones are different with respect to the one or more selected attributes of the zones they serve, and, the selected attribute or attributes are progressively varied across the transition zone, as described in more detail below.

The inventive subject provides notable improvements to the teachings in the '221 patent that are beyond the contemplation of that patent. In accordance with the embodiments shown in the Figures, a fabric construct 10 or 100 includes sets of longitudinal yarns and transverse yarns, known to persons skilled in art as weft and warp yarns, that are interwoven and intersect, forming a plurality of cells. The fabric may be made of any suitable material. In embodiments shown, the fabric construct may be laminated with one or more layers of constructs or materials, for example, polyester, nylon, cotton, silk, nanoweb, polypropylene or other polymer-based woven, nonwoven or knit constructs. The fabric constructs 10 or 100 may laminated with other plies of materials to form multilayer constructions. It is contemplated that a fabric construct may be dependent upon the nature of the object or garment for which the construct 10 or 100 will be used. For example, the composition of the base fabric construct 10 may be an elastic-based, stretchable material for athletes, fire resistant material for firefighters or high durability material for camping equipment and/or military purposes. Other materials suitable for use in the fabric construct 10 or 100 will be readily apparent to one of ordinary skill in the art from the teachings herein.

Referring to FIG. 3, in some embodiments, the weft yarns ($Y_1$, $Y_2$) and warp yarns ($Y_3$) may be orthogonal to one another, resulting in a crosshatched pattern of the pattern in the fabric construct. Other suitable configurations such as, for example, various diamond shapes, are also within the scope and spirit of the inventive subject matter. In some embodiments, the yarns have a denier rating in the range of from about 5 denier to about 1050 denier, depending on the object or garment. Higher denier yarns (e.g., 850 denier) are appropriate for objects consisting of, for example, heavier canvas materials while lower denier yarns (e.g., 70 denier) are more appropriate for, for example, lightweight jackets and camping equipment.

According to the inventive subject matter, different zones in the fabric construct 10 or 100 may indicate different areas of the construct have different attributes, e.g., abrasion, resistance, tensile strength, tear strength, stretch, waterproofness, or breathability characteristics. Thus, fabric 10 may take on the characteristic of multiple fabrics and may reduce or even eliminate the need to combine separate panels of different fabric types in developing a sophisticated object or garment. In one embodiment, the density of yarns and/or type of yarns (structure and/or materials) used in different areas may be different. For example, in some embodiments, the material used in different zones may be different. In yet another embodiment, manufacturing steps may process the different areas differently. A variety of manufacturing techniques may be used to make different areas of the fabric construct to have any of the aforementioned different fabric properties. For example, in one possible embodiment, shown in FIG. 1, nylon-based yarns are interspersed in the fabric at defined spacings to create a durability zone. ($Z_1$ in FIG. 1.) The durability zone may be based on a high tenacity yarn, such as nylon Cordura™ yarn. Alternatively, durability zone could be based on a ripstop fabric construction. In some possible embodiments, the yarns used for the ripstop lines may include, for example, silicon impregnated ripstop, polyurethane coated ripstop, reflective ripstop, heat and solar reflective ripstop. Other treatments readily apparent to one of ordinary skill in the art are within the scope and spirit of this invention based on the present disclosure.

In fabric construct 10 or 100, zone $Z_1$ is seamlessly connected in a unitary weave of fabric to an adjacent zone of different attributes, e.g., lower durability but higher permeability. In other words, the zones are formed in the same weaving process and are not separate panels that are joined together after each is woven. For example, referring to FIG. 3, all other things being equal, a zone of fabric construct 10 or 100 may be formed of cells that impart greater durability compared to a portion of the construct this is formed of cells of a different nature. The varied durability may be achieved by variations in, e.g., density of yarns, weaving patterns, materials (e.g., in terms of yarn structures and/or material types), manufacturing processes (chemical, mechanical, etc.).

As indicated above, in some embodiments, a multizone unitary fabric varies the breathability of the fabric construct 10 among the different zones of the construct. For example, zone $Z_2$, may be formed of larger cells of warp and weft yarn intersections. The varied breathability may also be achieved by variations in, e.g., density of yarns, different weaving patterns, different materials, and/or different manufacturing processes (chemical, mechanical, etc.).

Figure 7:
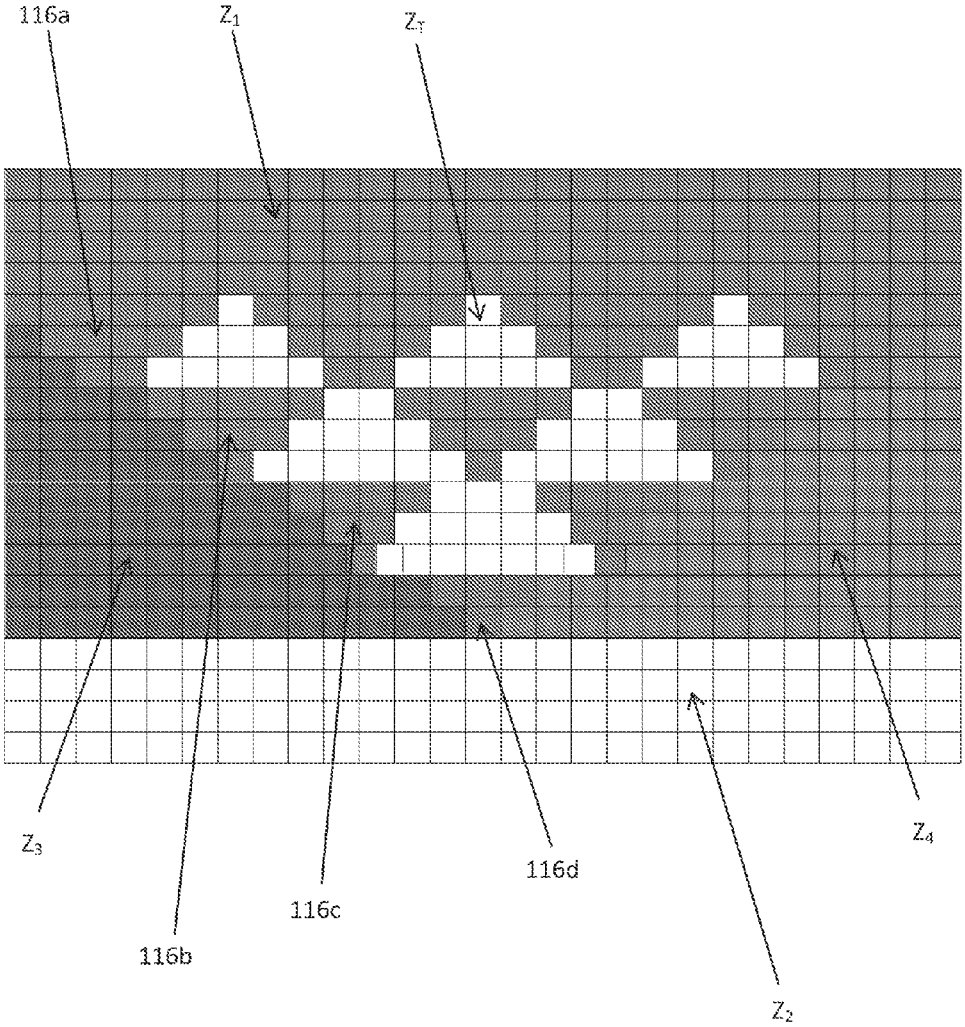
FIG. 7 shows representative weaving schemes for alternative transition zones.

In certain embodiments, as seen in FIGS. 1-2, for example, the fabric constructs disclosed herein come off a weaving machine as rectangular structures that have a warp length defined by the length of the set of yarns in the warp direction, and a weft width defined by length of the set yarns in the weft direction. Where the different zones in the fabric run orthogonal to the warp direction, the zones may be defined by a variation in sets of successive weft yarns, as seen in FIG. 3. And vice versa, where the different zones in the fabric run orthogonal to the weft direction, the zones may be defined by variations in sets of successive warp yarns. (See, e.g., FIG. 3C.) In other words, as seen in the Figures, the different zones $Z_1$, $Z_T$ and $Z_2$ may be defined in terms of parallel yarns that run edge to edge along the weft and/or warp directions. Although not shown, by varying both weft and warp threads, a rectilinear zone, as in a plaid pattern, of a different overall nature than other zone types, may be created amidst zones that are based on weft and warp yarn orientation. In such a rectilinear zone, the zone can be isolated in any section of the grid of the fabric and does not extend edge to edge, as in other embodiments. Other possibilities for a multizone fabric construct are illustrated in FIG. 7, which has a triangular shaped transition zone $Z_t$ spaced apart from the edges of the construct. Other zones $Z_1$, $Z_2$, $Z_3$, and $Z_4$, each of a different type, are adjacent the transition zone.

The fabric constructs, and consequently the zones in the fabric construct, may have varying dimension depending on application and intended use. In general, to provide for permeability or comfort in apparel, a given zone type may have a relatively large surface area. For example, a surface area of at least 4 square inches may provide breathability in an underarm area. A zone of 25 square inches or more may provide good breathability or protection in other areas of a garment. The inventive subject matter contemplates that the square inches of a zone in the fabric, as it comes of the weaving machine, may typically range from 1 to 900 square inches or more for a garment application, although higher or lower area may apply depending on the desired result. In certain embodiments, the zones are parallel areas that run edge to edge in the construct. A fabric construct may have any number of zones of two or more zone types. For example, there may be 2, 3, 4, 5, 6, 7, 8, 9, 10, 11, 12, 13, 14, 15, 16, 17, 18, 19, 20 or more different zone types, each representing a different functional attribute and/or visual-effects attribute. The attributes may be imparted by the nature of the yarn types and/or weave characteristics of a zone type.

Because the zones in the fabric construct must be usable with the pattern for a garment, it is generally contemplated that the edge-to-edge width of the zones in the weft or warp direction of a fabric construct coming off the weaving machines will be at least 1 inch so as to provide a minimum dimension of sufficient surface area for a functional zone in an end product such as a garment.

As used herein, the "height" means the dimension orthogonal to the width of the zone. The height of the zone may also be at least 1 inch. In some applications, the width of the zones may be at least 4, 6, 8, 10, 12, 14, 16, 18, 20, 22, 24, 26, 28, 30, 32, 34, 36, 38, 40, 42, 44, 48, 50, 52, 60, 62, 64, 66, 68, 70, 72, 74, 76, 78, 80, 82, 84 inches or thereabout. In many applications, the height of the zones may be at least 4, 6, 8, 10, 12, 14, 16, 18, 20, 22, 24, 26, 28, 30, 32, 34, 36, 38, 40, 42, 44, 48, 50, 52, 60, 62, 64, 66, 68, 70, 72, 74, 76, 78, 80, 82, 84 inches or thereabout.

In some applications, for example, tents, the various dimensions could be considerably larger. For some applications, such as fabrics for medical applications, the dimensions could be considerably smaller, e.g., scaled to use of nanofibers.

The relative heights of one zone to another may vary in a fabric construct as it comes off the weaving machine. However, they are generally going to be of similar scale or magnitude. For example, a set of adjacent zones may have relative heights that are within 0.25 to 10 times one to the other, or thereabout.

The spacing of the warp yarns may be uniform or may vary. The spacing may occur in a pattern. For example, the spacing may be uniform of a given first multiple of warp yarns and then change for second multiple of warp yarns. The foregoing is true for yarns in the weft direction. The spacing of the warp yarns may be the same or different from the spacing of the weft yarns. A fabric may preferentially show on a given side warp or weft yarns. For example, a fabric of a twill construction may preferentially show on one surface weft yarns that are floated over the warp yarns.

As another example, in a dobby or jacquard weave, a fabric may preferentially show warp yarns or weft yarns at a face surface by varying the relative spacing and number of a given yarn type. For example, a warp face or weft face fabric face may be determined by changing the relative cover of the warp and weft yarns.

The inventive subject matter contemplates that the weave types used in any one or more zones may be any of a number of standard weave types. For instance, contemplated weave types include: plain, basket, ribbed, twills, satin, Dobby, Faille, Ripstop, and leno (imbalanced) and combinations there of. The fabric constructs and zones therein may be formed in whole or part from interwoven fabrics, using two or more sets of yarn, each at a different level in the construct. The woven fabrics may be produced on any type of standard loom, including, Jacquard, computerized Jacquard, Dobby, auto Dobby, and the like. Weft insertion can be accomplished through various methods including air jet, water jet, or rapier and the like.

The fabric constructs disclosed herein, which may be one or multiple layer construction, may be produced from yarns based on all-synthetic fibers, such as polyesters and polyamides, natural fibers, and combinations of natural and synthetic. Interwoven fabric constructs include: double cloth, double weave, and double-faced constructs.

Looking at some of the standard weaves in more detail, which are well known to persons skilled in the art, a plain weave is generally where the weft (filling) yarns pass alternately over and under the warp yarns. Plain weave fabrics include muslin, gingham, broadcloth and chiffon. 15

A basket weave is a common variation of the plain weave. This is where two or more yarns are placed together and treated as one during the interweaving process. Fabrics that use basket weave are Monk's cloth, oxford cloth and hopsacking.

In a twill weave, a yarn in one direction floats over two or more yarns in the other direction at regular intervals. Each float begins one yarn over from the last one. This creates the diagonal rib or cord pattern. Twill fabrics are tightly woven, producing a strong durable fabric. Fabrics with the twill weave include denim, gabardine and surah. Twill fabrics technically have different front and backsides, unlike a plain weave, whose two sides are the same. The front side of the twill is the technical face; the back is called the technical back. The technical face side of a twill weave fabric is the side with the most pronounced wale; it is usually more durable, more attractive, most often used as the fashion side of the fabric, and the side visible during weaving. If there are warp floats on the technical face (i.e., if the warp crosses over two or more wefts), there will be filling floats (the weft will cross over two or more warps) on the technical back. If the twill wale goes up to the right on one side, it will go up to the left on the other side. Twill fabrics have no up and down as they are woven.

A satin weave has long yarns that float on the surface. The warp yarns go over four or more filling yarns then under one. The next float begins two yarns over from where the last float began. The face of the satin weave is composed almost entirely of yarns running in only one direction. This creates a surface that reflects light and has a lustrous sheen. The satin weave is used to make satin and sateen fabrics. In satin the float is the warp yarn, in sateen the float is the filling yarn.

Pile weaves have extra loops or yarn ends projecting from the surface. They may be made either with plain weave or twill weave, in the case of velvet they are woven double face to face, cut down the middle to make two separate pieces of pile fabrics. Fabrics with this type of weave are corduroy, velvet, fake furs. Pile weaves and brushed surface fabrics have nap. Nap is a layer of fiber ends that appear different when viewed from different directions. Pile weaves may be one or both of a functional attribute and a visual effects attribute. For example, pile or napping may serve as a thermal insulator and/or well as an aesthetic surface texture.

In one or more embodiments, a fabric with a unitary, multizone structure manufactured according to this disclosure may use a different pattern to indicate the multizone structure. For example, one embodiment may have color patterns, and varied shades of colors may be used to indicate a multizone structure, as seen in FIGS. 4A-4D, as examples. Another embodiment may use repetitive patterns and varied densities of repetitive patterns may be used to indicate a multizone structure, as seen in FIGS. 2A-2B, and 4A-4D, which show such patterns, as well as color or shading variations. In a further embodiment, a fabric with a multizone structure manufactured according to this disclosure may use no visual pattern to indicate the multizone structure.

Any fabric construct, or portion thereof, may comprise a one-layer, 1.5 layer, a two-layer, 2.5 layer or three-layer construction. The top (outermost) layer may be one type of material (e.g., yarns or deposited chemical materials) suitable for external use (e.g., exposed to the outside) and the bottom innermost layer may be one type of material (e.g., yarns) suitable for internal use (e.g., in contact with human body). The middle layer may comprise a woven material that resists tearing and ripping due to a crosshatched threading, or it may be a non-textile material. The multizone structure of a fabric construct 10 or 100 may be implemented in any one or more layers. In one possible embodiment, the multizone structure may be laminated onto a middle layer. In another possible embodiment, the multizone structure may include printed or otherwise deposited material that forms a layer.

FIGS. 4A-4D show front and back views of a garment 200 that is made from a fabric construct like construct 100. For illustrative purposes, the garment is a jacket shell. It will be appreciated, however, that the fabric constructs 10 or 100 can be used with any suitable garment, or object including, but not limited to, objects or garments commonly used in camping, sporting, firefighting and other professions, the military and fashion or any other arena readily apparent to one of ordinary skill in the art.

In one possible embodiment, the fabric construct 10 or 100 may be made of nylon, polypropylene, nylon, polyester, wool, cotton, and/or any suitable material, alone or in combination. A layer in a garment using the construct may be a waterproof, breathable membrane such as expanded polytetrafluoroethylene (ePTFE).

In any embodiment, the manufacturer may also select a zone of the fabric 10 or 100 to correspond to a portion of the garment based on at least one zone structure indicated by the pattern 15 or 150. The mapping of the zones of the fabric construct to zones of the garment may be referred to herein as a "zonal profile". In this example embodiment, portions of the fabric construct 100 correspond to areas of the jacket 200. Each area of the jacket 200 may have different requirements in terms of various attributes, such as durability, breathability, elasticity and/or waterproofness. For example, the shoulder areas of the ventral and dorsal section areas and the lower sleeve portions may require greater durability but less breathability than other areas, which require more breathability. Looking at FIG. 5, dark and light regions in a suit 300 of a jacket and pants indicate different zone types. The jacket includes multiple, dark zones of a first zone type of high durability fabric in shoulder area 21.2, upper arm area 21.2, elbow/lower arm area 21.3, wrist or cuff area 21.4, hip area 21.5, knee area 21.6, lower leg and ankle area 21.7, head area 21.8 and zipper area 21.9. Lighter colored areas may be a zone type of more breathability, elasticity, pliability or other desired attribute.

Figure 6:
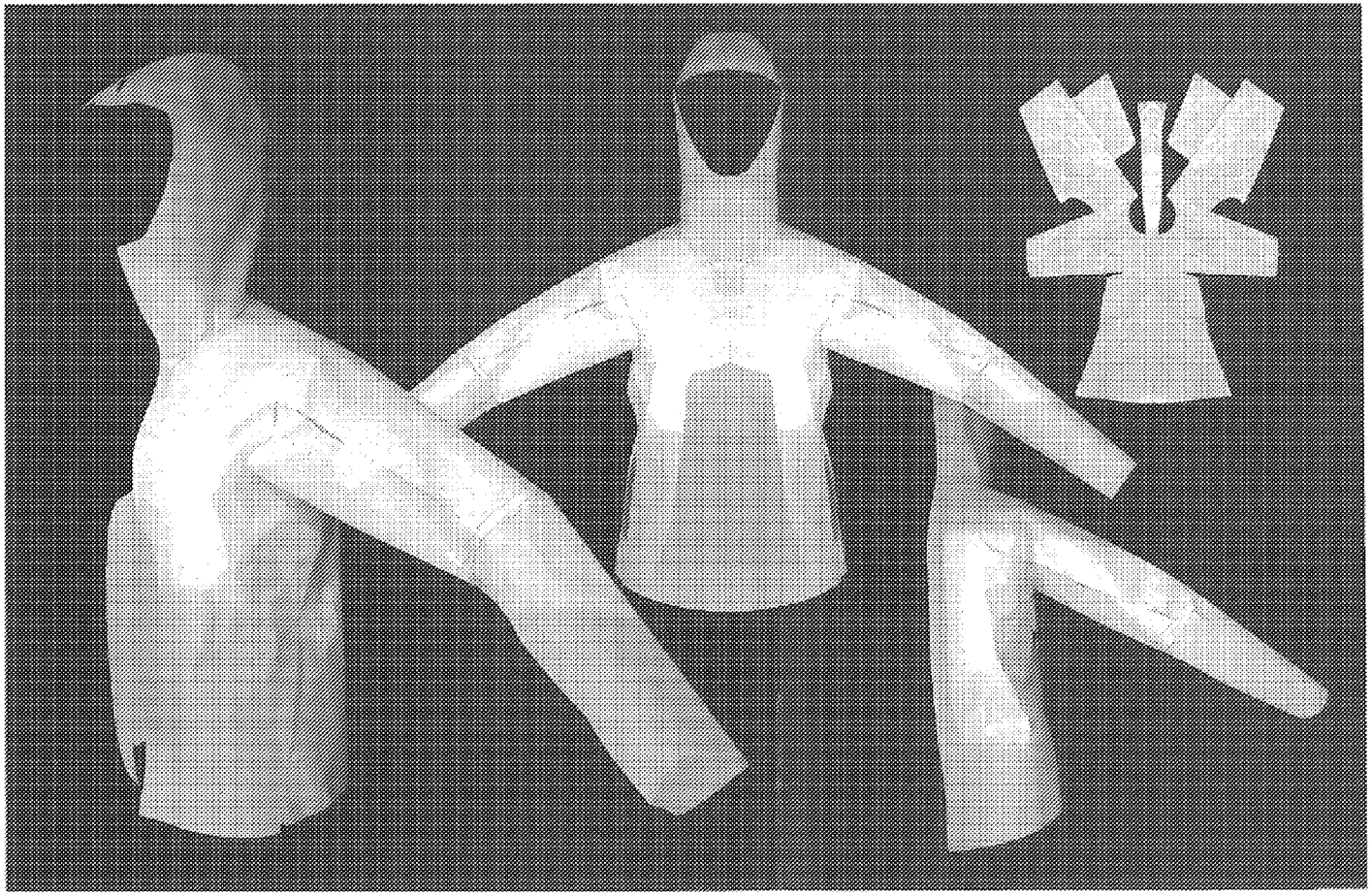
FIG. 6 shows a representative textile construct cut from a pattern on a textile such as shown in FIG. 1 or 2 along with a folded, stitched jacket made from the construct.

As illustrated in FIGS. 1, 2, and 6, for example, a garment may be cut as one or more components from a fabric construct and seamed, fused, taped or otherwise joined together to form a garment such as garments 200 or 300. For example, the component parts may be seamed together using any suitable means known in the art, for example, using flat, reinforced, and/or curved stitching. The patterns of FIGS. 1 and 2 show jackets that can be cut are as a single object that represents a complete jacket shell. FIG. 6, in the upper right corner, shows an example of a fabric construct cut from a pattern that can be formed in a three-dimensional garment 300. The shell can be assembled in substantially complete form without the need to add other components to complete the shell form.

As disclosed herein, the human body has differing needs in terms of apparel durability, waterproofness, breathability, thermal insulation or conductivity, elasticity, comfort, and/or hand. Other suitable characteristics include, but are not limited to, the visual appearance of the garment. Based on the zonal profile, appropriate zones of fabric construct for a garment can be ascertained.

Accordingly, by constructing a textile composition by forming a fabric construct of a unitary, multizone structure, and varying properties across zones in a controlled manner, a customized garment 100 can be created using one or more pieces cut from a single fabric construct. Thus, the single fabric construct 10 or 100, for example, may take on characteristic of multiple fabrics.

Figure 3A:
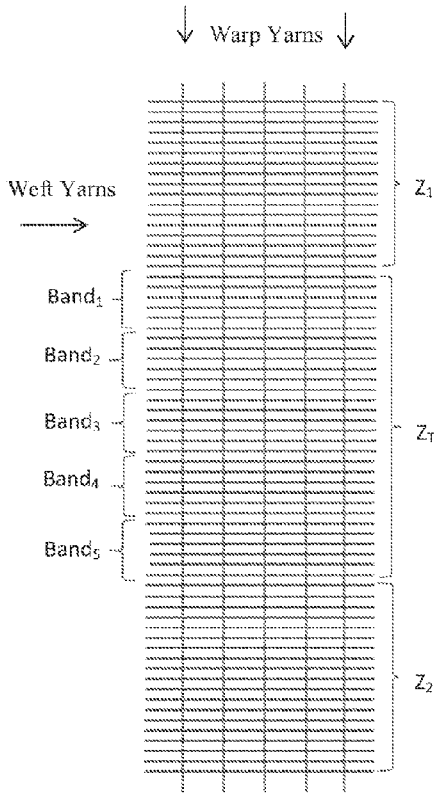
FIG. 3A shows a weaving scheme for a transition zone.
Figure 3B:
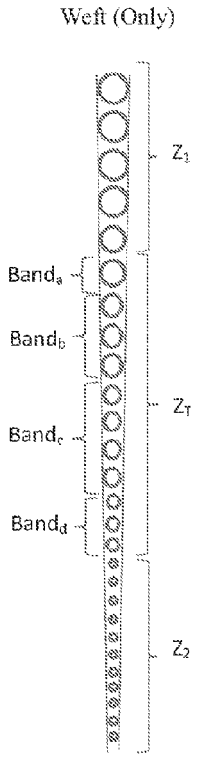
FIG. 3B shows an alternative embodiment for a weaving scheme for a transition zone.
Figure 3C:
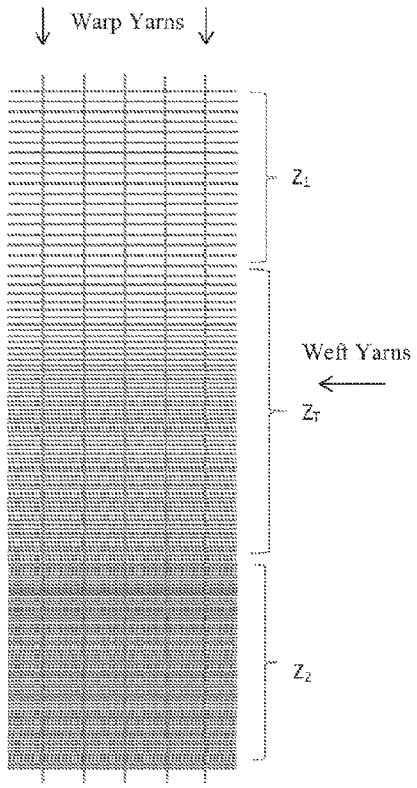
FIG. 3C shows an alternative embodiment for a weaving scheme for a transition zone.

In any embodiment, the weave type of a given zone may be varied in at least four ways, which are schematically illustrated in FIGS. 3A-3C: (i) use of different yarn types (FIG. 3A); (ii) differences in denier for a given thread or yarn (FIG. 3B); and (iii) higher density of cross-over points (FIG. 3C). Additionally, denier can effectively be changed by use of multifilament yarns, e.g., twisting together of the same of different thread or yarn types.

FIGS. 2, 4A-4D, and 6 illustrate details of possible embodiments of jackets formed from a single layer of fabric and which includes multiple zone types, at least one of which is transition zone type. Fabric constructs with transition zones may be made using various kinds of weaving machines and processes. In this example, the fabric construct for the jacket shown may be made using a Dobby weaving machine or a Jacquard weaving apparatus for individual control over warp yarns.

Figure 4A:
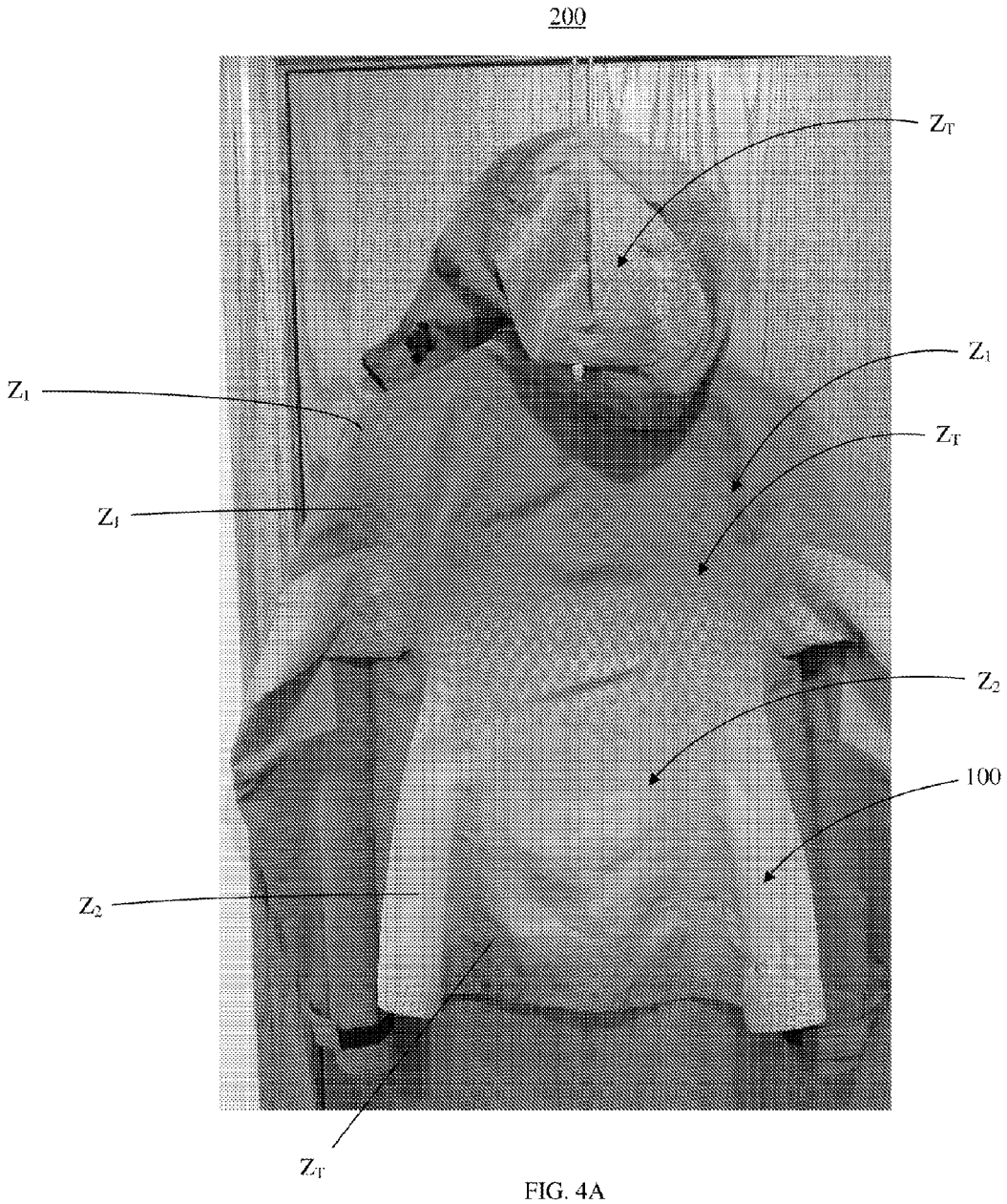
FIG. 4A shows a backside, outer surface of a jacket shell made of textile similar to that shown in FIG. 2A.
Figure 4B:
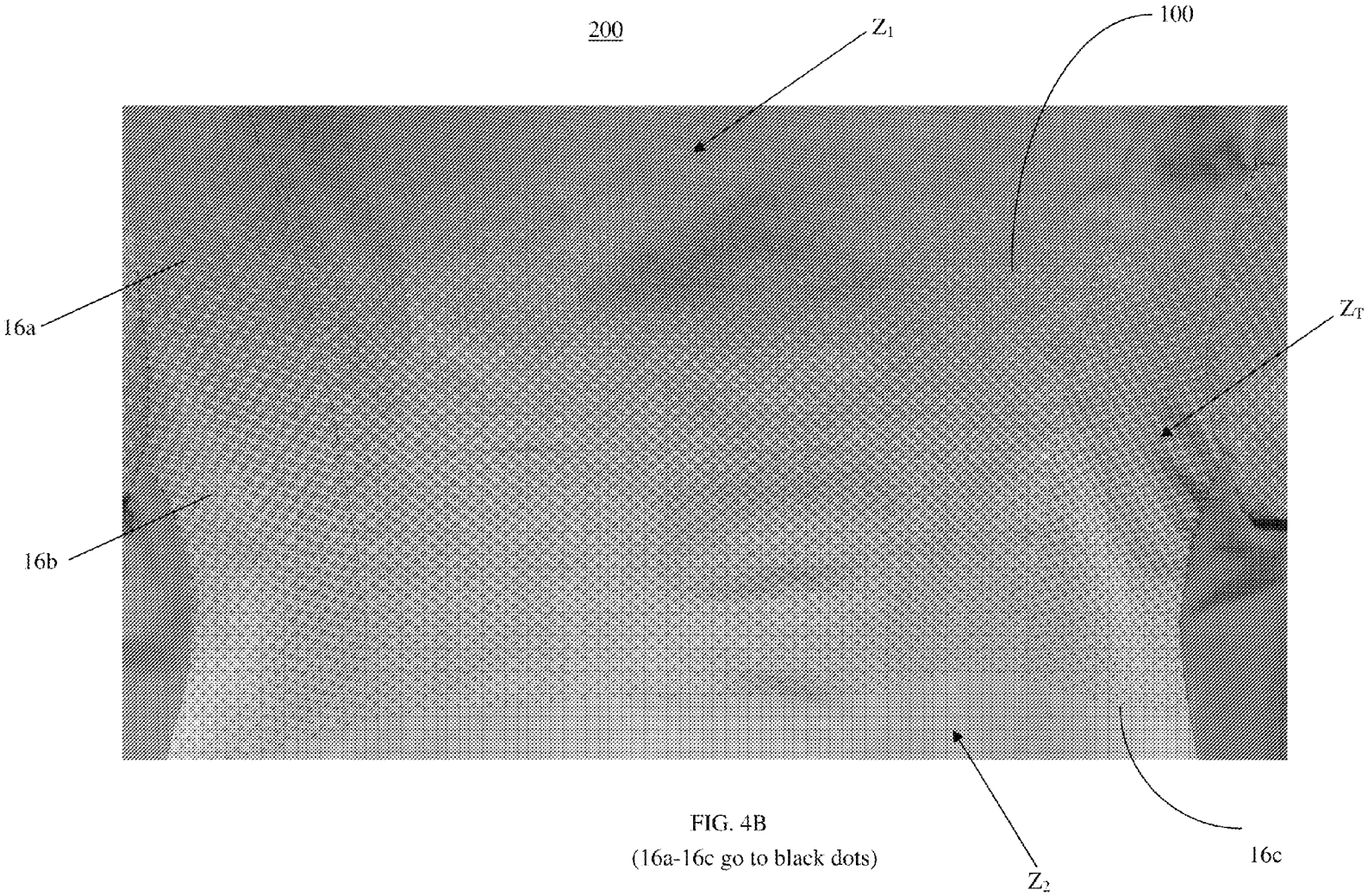
FIG. 4B shows an enlargement of the transition zone area on the outersurface jacket shown in FIG. 4A.
Figure 4C:
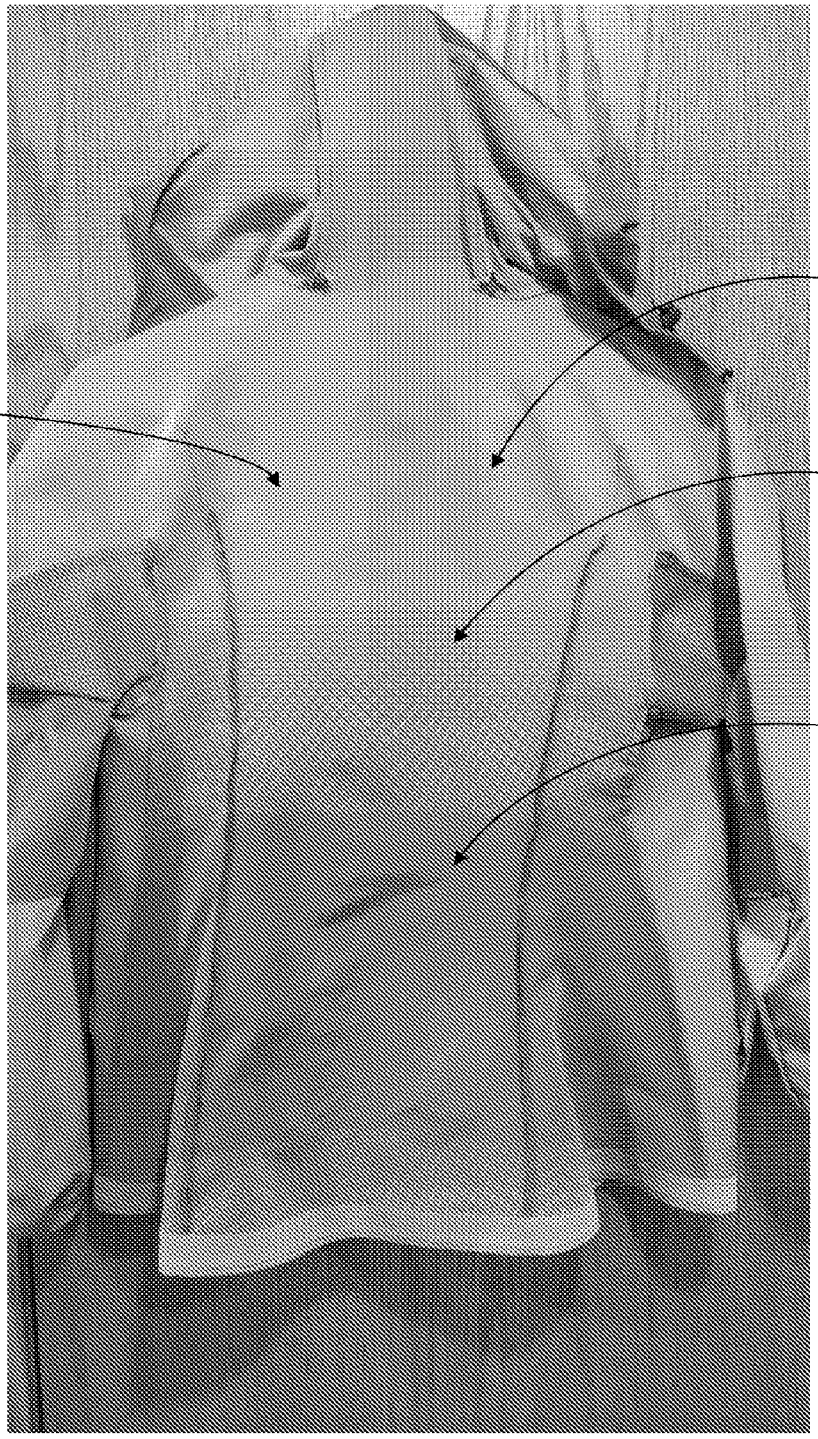
FIG. 4C shows a backside, inner surface, which is on the opposite side of the outer surface of the jacket of FIG. 4A.
Figure 4D:
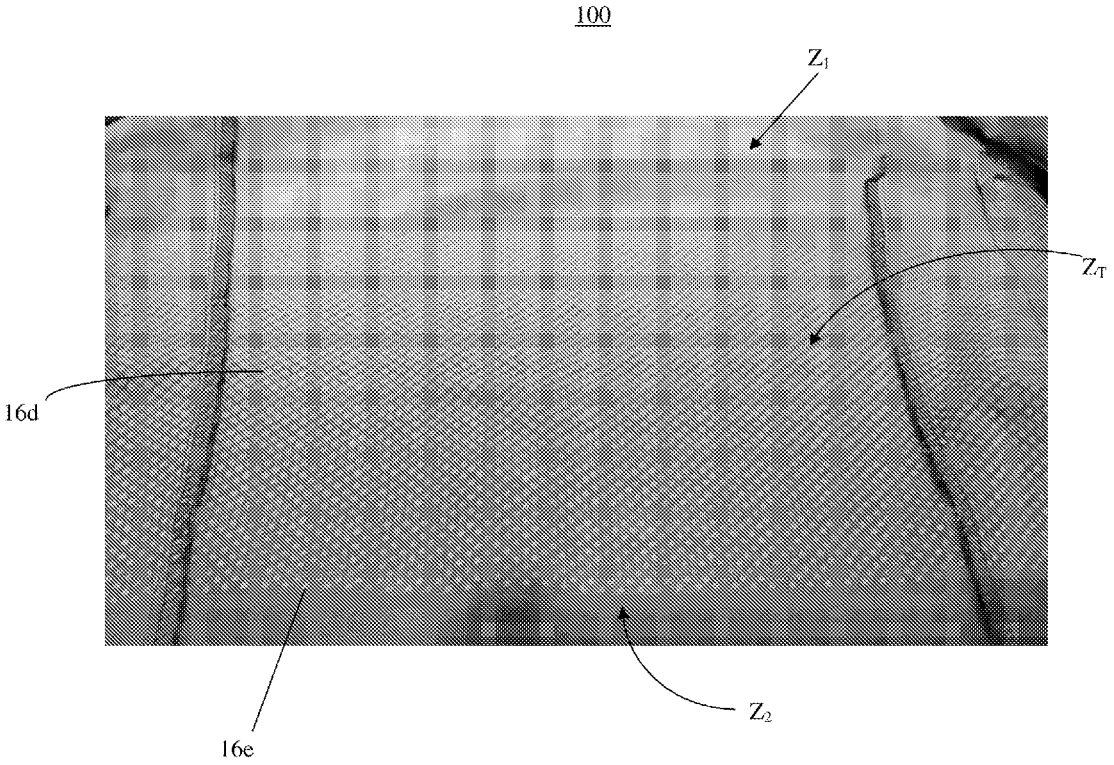
FIG. 4D shows an enlargement of the inner surface of the transition zone area shown in FIG. 4B.
Figure 5:
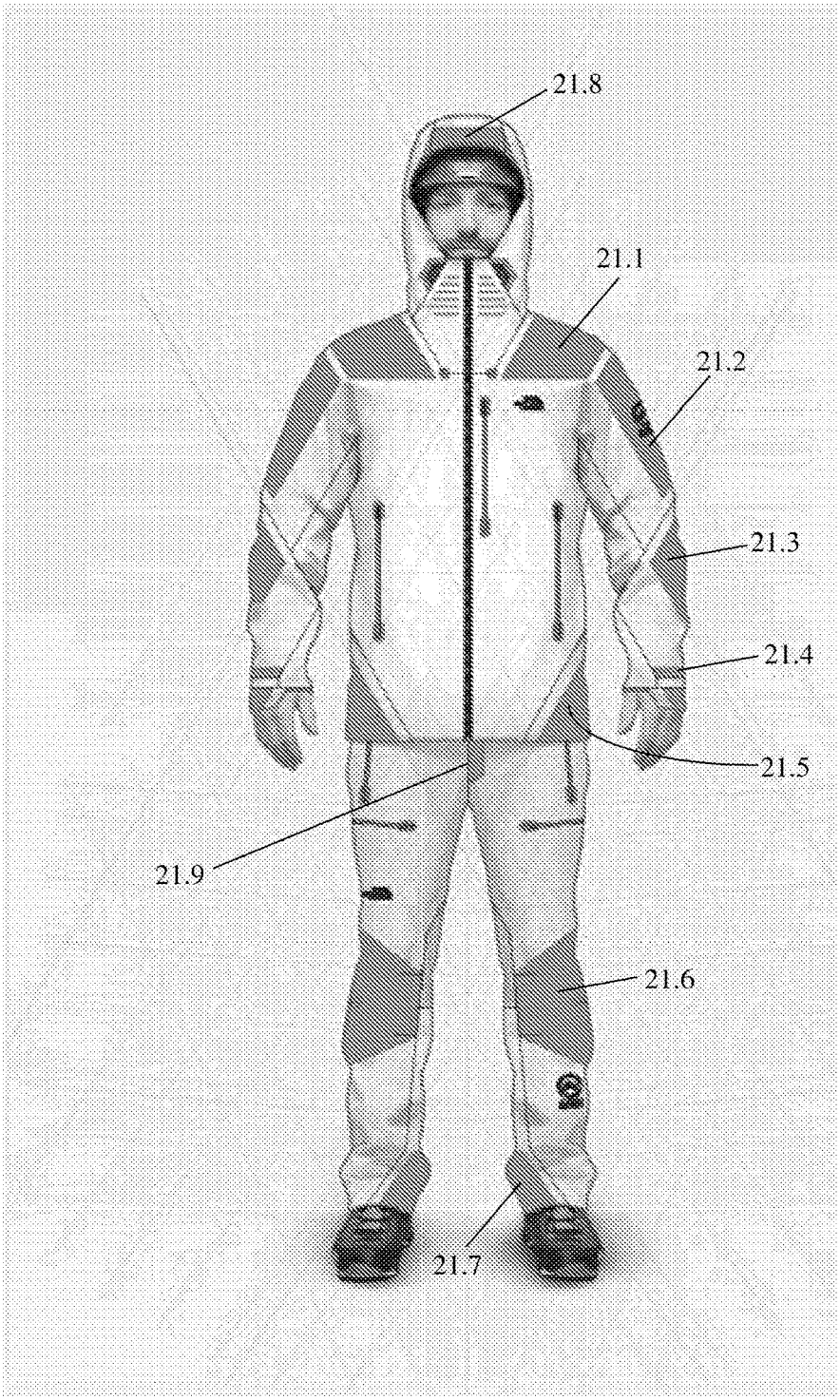
FIG. 5 shows representative garments made of a textile with multiple zones mapped to selected body areas of an intended user, all zones in a unitary woven, seamless construction.

In this example, zones $Z_1$, $Z_2$, and $Z_T$ are part of a unitary woven construct with seamlessly joined zones, and are generally represented in the pattern illustrated on the construct of FIGS. 2-3 although that pattern may not be an identical match. In this example, all zones are constructed of a twill weave. FIGS. 4A-4D show a backside of overall jacket shell 200. The backside has an outer surface that would face away from the user and an inner surface that would face the user. FIG. 4B shows a detail from FIG. 4A. In FIGS. 4A-4B, the outer surface is showing. In FIGS. 4C-4D the inner surface of jacket 200 is showing. FIG. 4D shows a detail from FIG. 4C. The jacket has three zone types, a first zone type $Z_1$, a second zone type $Z_2$, and a transition zone $Z_T$. In this embodiment, the zones are parallel to each other and run edge to edge across the fabric construct, like shown in fabric construct 100 (FIG. 2), as it is completed off the weaving machine. Each zone of a given type in the fabric construct maps to a portion of a pattern for a garment or other end product, which in turn maps to a portion of the garment or other end product.

As can be seen, the pattern on fabric construct 10 or 100 may break a given zone down into different zones on the pattern. In other words, there is 1× or greater multiple of zones in the end product for each zone in the garment. For example, zone $Z_2$ in the fabric construct 100 are used to create distinct zones for $Z_1$, $Z_2$, $Z_T$ in the garment 200. A given zone in the construct may be used to create two, three, four or more zones in the garment or other end product.

As example of a zone type, FIGS. 4A-4C show a backside of jacket 200 where a first zone type $Z_1$ is disposed in a generally central area of the back of the jacket. A transition zone $Z_T$ is disposed below and adjacent to the first zone type. It provides for a transition in the attributes of one adjacent or nearby zone to those of another adjacent or nearby zone, as discussed in more detail herein. Below and adjacent to the transition zone is the second zone type $Z_2$. Like any other zone, multiple sets of transition zones may be present in the fabric construct and resulting end product.

In the example shown, the same type of warp yarns are used across all zones. The warp yarns are oriented parallel to the long axis (cephalocaudal axis) of the user's body. The weft yarns are oriented perpendicular to the long axis.

Therefore, the attributes of the zones may vary according to the weft yarn types and/or weaving types used. In other embodiments, the weft threads could be constants across zones and the warp threads varied. In other embodiments, both warp and weft threads could be varied. Accordingly, zone attributes depend on the nature of the weft yarn types, warp yarn types, and/or weave types in different zones. To illustrate further, in any given construct, while the warp yarns may remain constant, they do not necessarily need to be the same yarn type across the warp direction. For example, the yarn type may change moving across the warp. The variation may be in terms of yarn material, denier, or any other yarn attributes. The variation may have a pattern, for example, one yarn type may be a base yarn type, with a different yarn type being present after given multiples of the base yarn type. This is illustrated in FIG. 3A, for example. Any plurality of different yarn types may be arranged in the warp direction.

As an illustrative example, the warp yarns in jacket 200 may be polypropylene yarns. Polypropylene is a relatively lightweight yarn for garment applications and has the advantage of wicking moisture away from user of garment. In jacket 200, there are a plurality of zones of a first zone type $Z_1$ which are represented by the darker grey areas, weft yarns are relatively high in durability to provide a durability zone type. For example, they may be a high tenacity Nylon, such as a 70 D or higher denier Nylon 6,6 or a Cordura™ Nylon. There are a plurality breathability zones $Z_2$ of a second weaving type using a lighter yarn type, such as Nylon 40 D. The breathability zones may also be considered a lighter weight, more pliable zone construction than the construction of heavier denier durability zones.

There is a transition zone $Z_T$ between the differing functional zones $Z_1$ and $Z_2$. In transition zone $Z_T$, there is a blend of the heavier and lighter weft yarns specific to each adjacent zone (i.e., the durability zone and the breathability or lighter weight zone). The blending of such weft yarns in the transition zone progressively increases in the direction of a given adjacent zone to become more like that adjacent zone.

According to the inventive subject matter, the transition zone may be in the nature of a zone that progressively changes in one or more attributes from one side to another. For example, it may be in the natures of a continuum, gradient, or spectrum of attributes between adjacent or nearby zones of other types so that there is a smooth transition of selected zone-type attributes from one zone, through the transition zone, to the other zone.

The transitioning need not be for all the attributes of a given zone or set of zones. For example if a first zone has unique durability attributes based on yarn types and visual effects attributes, and the second zone has unique breathability attributes based on openness of weave type, and a unique visual effects attributes, various forms of transitioning are possible. For example, the transition zone could only provide for smooth transitioning of a heavier yarn type in the first zone to a lighter yarn type in the second zone. Alternatively, it could only allow for transitioning of a tighter weave in the first zone type to a more open weave in the second zone type. Alternatively, it could only allow for transitioning of, for example, black-colored yarns in the first zone type to white colored yarns in the second zone type. Combinations of attribute transitions are also possible. For example, the transition zone could allow for smooth transitioning of weave openness and yarn color. Alternatively, it could allow for transitioning of all attributes in the examples, namely denier of yarn type, weave openness, and yarn color. In short, any one or more attributes may be transitioned alone or in any selected combinations.

Transitioning can be achieved in any number of ways based. For example, where warp yarns are constant, going across the transition zone from a first zone to a second zone, the transition zone may be defined in terms of a plurality of bands of one or more weft yarns in a pattern. (FIG. 3A.) The composition of yarn types or spatial relationships of yarns from band to band are varied to collectively provide for a progressive transition between zones. (FIGS. 3B-3C.) Instead of, or in addition to, progressive banding of weft yarns, the warp yarns could be banded in such fashion as described above (or below) to create a progressive transition across a defined transition zone.

Referring to FIGS. 3A-3C, as an example of progressive bands of weft yarns, the bands closest to the first zone $Z_1$ could have a relatively high percentage of weft yarns of the same type as the first zone and a relatively low percentage of weft yarns of the same type as the second zone, with the percentage varying from band to band. (FIG. 3A.) With each successive band closer to the second zone, the percentages shift to become more like that of the second zone. Progressive banding can also be achieved using just one yarn type, not a blending of yarn types of the first and second zones based on variations other properties for a zone. For example, the bands could have just the yarn type of the first zone type and not include any of the second zone type. The first yarn type may be combined with another yarn type that is different from the weft type of the second zone. For example, the other yarn type could be the same yarn type used in the warp threads or entirely different from any yarn type used in the first and second zones.

To illustrate a range of other possibilities, if the warp yarns are a lightweight yarn, such as polypropylene, and the first zone is a durability zone of a high tenacity yarn, such as, but not limited to, 70 D Nylon 6,6, and the second zone is breathable, lighter weight zone that includes a lightweight Nylon, such as 40 D Nylon. The transition zone could be based on a combination of any of the three yarn types in bands that progressively shift across the transition zone. If just a single yarn type is used, for instance, breathability could be achieved by varying the weave type, as discussed elsewhere herein.

In combination with variations in yarn types and blends, or as an independent form of progressive transition, the weave type may be varied going from one zone type to another. For example the first and second zones could have the same type of yarns but differ in weave types. The transition could be in terms of going from a zone of tight weave (high fabric count) to a zone of relatively loose weave. By varying the yarn types and/or weave types, each of the successive bands in a progressive transition may or may not be based on use of the same yarn types or weave types as in adjacent or successive bands.

Further, the yarn types in the bands need not be the same as any yarn type used in the first or second zones types. Instead, they may be different but may still provide for a progressive transition in the attributes of one zone type to another. To illustrate, if warp threads are polypropylene, for example, and the first zone is a durability zone of a high tenacity yarn, such as 70 D Nylon 6,6, and the second zone is a breathable, lighter weight zone of a relatively light weight Nylon, such as 40 D Nylon, the transition zone could be constructed from a set of bands that are not the same as in the first and second zones but which have varying denier and tenacity that is intermediate those zones. For example, a first band proximate the first zone could be 65 D Nylon, a successive band closer to the second zone could be 55 D Nylon, a third band even closer to the second zone could be 50 D Nylon, and so forth.

The number of bands in a transition zone can vary from a few to a multitude, depending on desired properties. However, in general to provide for progressive transition in apparel applications, a transition zone of at least three bands may be suitable. However, finer granularity may be desirable, and the number of bands each providing for a successive progression of properties may be 4, 5, 6, 7, 8, 9, 10, 15, 20, 30, 40, 50, 100, 200, 300, 400, 500, 1000, 10,000 or more, or any value or range in between.

It is generally contemplated that the edge-to-edge width of the zones in the weft or warp direction of a fabric construct coming off the weaving machines will be at least 1 inch so as to provide a minimum dimension of sufficient surface area for a functional zone in an end product such as a garment. In many applications, the height of a band, as defined by the height of the set of parallel threads for the band, may be a percentage of the overall height of the transition zone containing the band. In many applications, the height of a given band may be 0.001%, 0.01%, 0.1%, 1%, 4%, 6%, 8%, 10%, 12%, 14%, 16%, 18%, 20%, 22%, 24%, 25%, %, 26%, 28%, 30%, 32%, 33%, 34%, 36%, 38%, 40%, 42%, 44%, 48%, 50% or thereabout the height of the transition zone.

In some applications, for example, tents, the various dimensions of zones of any type or bands in a transition zone could be considerably larger. For some applications, such as fabrics for medical applications, the dimensions could be considerably smaller, e.g., scaled to use of nanofibers.

In some embodiments, there is a changeover point in the transition where there is selective change in the floating or facing of one yarn type. For example, (1) in a first portion of the transition zone proximate the first zone, weft yarns that are reflective of the weft yarns in the first zone are floated to place them at the face of the fabric and/or (2) in a second portion of the transition zone proximate the second zone, weft yarns that are reflective of the second portion are floated to place them at the face of the fabric.

In certain embodiments, a progressive transition of attributes may be created by selectively floating yarns. For example, yarns may be floated in successive rows to define a pattern of discrete shapes that progressively change across the transition zone and thereby define the progressive transition of attributes in a transition zone, at least in part. This is seen, for example, in the transition zone $Z_T$ of FIGS. 2 and 4, and schematically illustrated in FIG. 7. Using selective floating, a transition zone may be from edge-to-edge in the fabric construct, or it may be defined in discrete areas that are spaced from the edges of fabric construct, anywhere in the grid of the fabric construct.

The pattern may be a pixelated pattern with progressive change in pixel size, shape and/or spacing, as seen in the Figures. A Jacquard control may be used to selectively float weft threads at a face of a fabric. The density, size, or shape of dots or other pattern elements may be progressively changed in the transition zone to a progressive transition in terms of functional and/or visual effect, as seen in FIG. 7, for example. That Figure shows elements 116*a*, 116*b*, 116*c*, 116*d* defined by floating of sets of dark colored weft yarns over sets light colored warp yarns. The number of warp yarns over which the weft yarns float and consequently the element size decrease with each successive row (band) of elements. This is also seen in the pattern represented by pixel-like or dot elements 16*a*, 16*b* and 16*c* in jacket shell 200 of FIG. 4B. Like in the schematic of FIG. 7, the elements are sets of floated yarns. Like in FIG. 7, the weft yarns in FIG. 4B are dark colored and the warp yarns are light colored. However, on the reverse side, because of the selective floating of the dark weft yarns on the fabric's face, the dots have the light color of the warp yarn, as represented by elements 16*d* and 16*e* in FIG. 4D.

A twill weaving process may be used to provide for selective floating of weft yarns at a desired side of the fabric. In other embodiments, the weft or warp threads may have a differing cover so that one or the other is selectively placed at the face of the fabric.

Change in the float of a yarn in a fabric construct can affect functional, as well as visual attributes of the fabric construct. For example, areas of low float density may be more durable, more stretch resistant, and/or less permeable compared with areas of higher float density.

In summary, the inventive use of a transition zone provides for smoother blending of functionality between functional zones. It also allows for better management and presentation of the aesthetics in the garment, eliminating abrupt transitions between the aesthetics of one zone to another.

Pattern Design

Advantageously, to eliminate the need to cut, assemble and stitch multiple components, the pattern for the garments shown in the Figures may be formed as a singular, flat cutout for at least the body portion. The patterns shown allow for the front and back portions of certain zones to fold into a three dimensional shape to receive corresponding body parts. The folded portions have edges that align and are stitched and optionally taped together. For example, looking at the jacket shell of FIGS. 2 and 6, front and back portions of the durability zones, and the breathability zones come together in such fashion. However, in some cases the front and back portions of the shell do not necessarily have a corresponding portion on the opposite side. For example, a durability zone back portion, which corresponds to the shoulder blade does not necessarily have an opposing portion in the breast area. The breast area could be simply in a breathable zone. As another example, pockets on the front of the jacket could be in a durability zone embedded in a larger breathability zone. As a further example, an elbow area on the sleeve portion of a shell could be formed of a durability weave while an adjacent sleeve portion could be formed of a breathability weave. The foregoing zone functionalities are for illustrative purposes and the principles may apply to any two or more functional zone types in any number of combinations or arrangements on a garment or other kind of end product.

In formulating a pattern that minimizes seams that must be joined to create a volumetric space, considerations include laying out zone types that map to specific areas and extend across back and front sides, where applicable. In the example shown, the outlined portions in the pattern have angles, curvatures and fold lines calculated to create a volumetric space for receiving a user's torso, neck and arms and optionally a head area. More particularly, two-dimensional patterns can be created from 3D renderings of the garment or other object. Once there is a 3D representation, manual approaches and/or software tools may be used for creating a "mesh" for the object.

A polygon mesh is a collection of vertices, edges and faces that defines the shape of a polyhedral object in 3D computer graphics and solid modeling. The faces usually consist of triangles, quadrilaterals or other simple convex polygons, since this simplifies rendering, but may also be composed of more general concave polygons, or polygons with holes. Different representations of polygon meshes are used for different applications and goals. The variety of operations performed on meshes may include Boolean logic, smoothing, simplification, and many others. Volumetric meshes are distinct from polygon meshes in that they explicitly represent both the surface and volume of a structure, while polygon meshes only explicitly represent the surface (the volume is implicit).

Various computer programs are available for creating an initial 3D rendering, such as graphic design and CAD programs, including well-known programs, such as Adobe™ Illustrator and AutoCAD™ programs. Once a 3D rendering is created, a "UV mapping" operation may be performed that may include the meshing function and which may be used to render the 3D object as a 2D pattern or a close approximation. UV mapping is the 3D modeling process of making a 2D image representation of a 3D model. A UV map can either be generated automatically by the software application, made manually by the designer, or some combination of both. Often a UV map will be generated, and then the designer will adjust and optimize it to minimize seams and overlaps. If the model is symmetric, the designer might overlap opposite polygons in the mesh to allow both sides to be simultaneously represented with the same surface texture, which according to the inventive subject matter translates to the same woven zone type.

When a model is created as a polygon mesh using a 3D modeler, UV coordinates may be generated for each vertex in the mesh. One way is for the 3D modeler to unfold the triangle or other polygon mesh at the seams defined by a set of successively connected sides of the polygons, automatically laying out the polygons in a two-dimensional pattern. If the mesh is a UV sphere, for example, the modeler might transform it into an equirectangular projection. The designer may then determine from a mesh generated for an object the appropriate fold and cut lines for joining and stitching of edges, while minimizing the layout of the pattern in a rectilinear footprint suitable for weaving. For an example of an open source meshing software see http://www.openmesh.org/.

The inventive subject matter contemplates various methods of forming articles of apparel. An article or item of apparel, as used herein, means a complete garment or substantial portion or component thereof, e.g., a torso portion, pants leg, sleeve, or hood. In general, the methods include forming a fabric construct configured with a size, shape, and selected zone types for use in making an article of apparel. Accordingly, the method steps include: providing a set of warp yarns on a weaving apparatus and weaving a set of weft yarns into the warp yarns to produce a woven zone of a first zone type; providing a second set of weft yarns on the apparatus and weaving the second set of weft yarns into the warp yarns to produce a woven zone of a second zone type; providing a third set of weft yarns on the apparatus and weaving the third set of weft yarns into the warp yarns to produce a woven zone of a third zone type. The third zone may be a transition zone disposed between the first and second zones. All the zones are formed as a unitary woven construct, with adjacent zones seamlessly joined together. In some embodiments, the transition zone consists of a plurality of bands of sets of weft yarns that collectively provide a progressive transition of the properties of the first zone type to the properties of the second zone type. The steps need not be performed in the order recited or in any particular order. However, in general using conventional weaving machines, the first zone is woven first, the transition zone is woven next, and the second zone woven after the transition zone, resulting in the transition zone being sandwiched between the first and second zones.

In the contemplated methods, the first and second zone types may be determined by differences between the sets of the weft yarns used in the first zone and the second zone. In the contemplated methods, the first and second zone types may be determined by differences between the sets of the warp yarns used in the first zone and the second zone. In the contemplated methods, the first and second zone types may be determined by differences between a weave type attribute used in the first zone and the second zone.

The contemplated methods may include mapping a pattern of an article of apparel to the fabric construct so that the zones in the fabric each map to different areas on the article of apparel. In the contemplated methods, each zone on the fabric construct may be distributed to two or more separate and different areas on the article of apparel that each provide a difference for a selected functional or visual effects attribute.

After the fabric construct is completed on a weaving machine, the following steps may be performed towards producing an article of apparel: cutting the fabric construct according to a predetermined pattern or design; and assembling the fabric construct into an item of apparel according to a mapped pattern or design. Any form of cutting may be used, including scissoring, stamping, or other actions based on sharpened edges; thermal knifing; laser cutting; and water jetting.

The assembly steps may include folding zones in the fabric construct to place a zone of a given type on different sides of the apparel item. The assembly steps may include joining seams in the cut fabric to form enclosures for the user's body, e.g., sleeves, legs, hoods. Additional elements may be added to the article, such as zippers, snaps, buttons, pockets, hook-and-loop fasteners, thermal insulation, etc. Methods of joining or adding include, stitching, taping, gluing and thermal bonding.

As discussed above, some embodiments contemplate generating a 3D meshing consisting of a set of polygons arranged to correspond to a 3D rendering of the article of apparel. The fabric may then be folded and/or cut along a plurality of edges of the polygons.

To minimize waste in the manufacturing process, the width of the warp or weft of a fabric construct may be the same as or closely approximate the width of the pattern intended for use with the construct. The weaving process for a fabric construct corresponding to a given pattern may be set up as a continuous process so that a roll of fabric is generated with repeating sections for a given fabric construct.

Other Applications

It should be appreciated that while the illustrated products herein all relate to items of apparel. However, the principles of the inventive subject matter could be applied to other items of apparel beyond those shown, such as long and short pants, vests, shoe uppers, hats, gloves, etc. The principles may also apply to other items including tents; backpacks; duffel bags; other luggage or carrier items; upholstery; bedding; floor coverings; and any other end product that uses woven fabric.

Definitions and Terminology

A "filament" is a continuous strand of fiber with much longer length than staple fiber. All man-made fibers are filament fibers, but the only natural fiber that is a filament fiber is silk. Filaments are of two types: monofilament and multi-filament.

A "yarn" is the long twisted and drafted strand of bundles of fibers either natural, man-made or a combination of both in the form of blend. It is the end product of a spinning process in the textile industry.

The term "thread" is typically used for ply yarns. When two or more than two yarns are twisted together to make a ply yarn by means of doubling process that comes after spinning, the end-product is called thread. A common example of thread is sewing thread.

Filaments, yarns or threads are all filamentous structures that may each be used independently or in combination in making a woven or knitted fabric. So, for the sake of convenience, as used herein, reference to any one such structure in this specification or in the appended claims or Figures, is meant to encompass all three types of filamentous structures, unless a distinction is called out or clear from context. For further convenience, "yarns" is the term that is primarily used herein as encompassing of yarns, threads, and filaments.

A "fabric" the end-product of a weaving or knitting process, but are used herein, a fabric means the end product of a waving process. As used herein, the terms "fabric" and "textile" are used interchangeably herein unless a distinction is called out or clear from context.

"Ends per inch" or "EPI" means the number of warp threads per inch of woven fabric. In general, the higher the ends per inch, the finer the fabric is.

"Picks per inch" or "PPI" means the number of weft threads per inch of woven fabric. A pick is a single weft thread. In general, the higher the picks per inch, the finer the fabric is.

"Fabric count", also referred to as "yarn count" or "thread count" means the number of warp yarn ends) and pick yarn ends (filling/weft yarns) counted per inch in a woven fabric. The fabric count is the number of ends times the number of picks in a square inch of fabric.

(Although the PPI, EPI or fabric count may be measured and reported in inches in the United States, it may also be reported per 25 mm, or 2.5 cm, as the SI unit is the internationally accepted unit for measurement.)

"Fabric density" is measured in general by what is termed a "cover factor." This factor measures the product of the number of warp yarns per inch of fabric and the square root of the denier of the warp yarn all added to the product of the number of weft yarns per inch of fabric and the square root of the denier of the weft yarn. A high cover factor fabric will therefore comprise relatively high denier yarns in both warp and weft directions, all woven to a high-picks-per-inch count.

"Tensile Strength" is the strength shown by a fiber, yarn, or fabric to resist breaking under pressure. It is the actual number of pounds of resistance that a fabric will give before the material is broken on the testing machine using a standardized testing method, such as an ASTM standard for textiles.

"Tear Strength" of fabric is the fabric's measure of resistance to tearing. Tear strength may also be used to illustrate the anisotropy of a material, e.g., testing in weft or warp directions. Force required to propagate an existing tear is measured. As a part of the preparation of fabric specimen, a cut is made in the fabric and the force that is required to extend the cut is measured using a standardized testing method, such as an Elmendorf tester and an ASTM standard for textiles.

Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

All patent and non-patent literature cited herein is hereby incorporated by references in its entirety for all purposes.

As used herein, "and/or" means "and" or "or", as well as "and" and "or." Moreover, any and all patent and non-patent literature cited herein is hereby incorporated by references in its entirety for all purposes.

The principles described above in connection with any particular example can be combined with the principles described in connection with any one or more of the other examples. Accordingly, this detailed description shall not be construed in a limiting sense, and following a review of this disclosure, those of ordinary skill in the art will appreciate the wide variety of systems that can be devised using the various concepts described herein. Moreover, those of ordinary skill in the art will appreciate that the exemplary embodiments disclosed herein can be adapted to various configurations without departing from the disclosed principles.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more".

All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed as "a means plus function" claim under US patent law, unless the element is expressly recited using the phrase "means for" or "step for".

The inventor(s) reserve all rights to the subject matter disclosed herein, including the right to claim all that comes within the scope and spirit of the following claims:

While the inventor(s) understands that claims are not a necessary component of a provisional patent application, and therefore has not included detailed claims, the inventor reserves the right to claim, without limitation, at least the following subject matter.

The invention claimed is:

1. An end product comprising an article of apparel or footwear that includes a fabric construct, comprising:

a woven fabric of weft and warp yarns, the fabric having a plurality of zones comprising at least one zone of a first zone type representing a first selected functional attribute; at least one zone of a second zone type representing a second selected functional attribute; and at least one zone of a third zone type, the third zone being a transition zone disposed between the first and second zones, all the zones being formed as a unitary woven construct with adjacent zones seamlessly joined together, at least a portion of the third transition zone being adjacent and in between at least a portion of each of the first and the second zones;

wherein the portion of the transition zone comprises at least five different bands of sets of weft yarns that are arranged to collectively provide a progressive and smooth transition of the selected zone-type attributes from the first zone, through the transition zone, to the second zone;

wherein in the fabric construct the height of a given band in a transition zone is 0.001% to 20% or thereabout the height of the transition zone to provide for the progressive, smooth transition of the attributes; and wherein the functional attributes represent material differences in durability, breathability, elasticity, comfort, waterproofness, and/or flame retardancy.

2. The end product of claim 1 wherein the first selected attribute for the first zone is dependent on a first yarn type in the first zone and the second selected attribute for the second zone is dependent on a second yarn type in the second zone, the bands of the transition zone comprise yarns of the first type and the second type, and the percent of the first yarn type in the bands progressively and smoothly decreases going from the bands adjacent the first zone to the bands adjacent the second zone.

3. An end product that includes a fabric construct, comprising:

a woven fabric of weft and warp yarns, the fabric having a plurality of zones comprising at least one zone of a first zone type representing a first selected functional attribute and a first selected visual attribute; at least one zone of a second zone type representing a second selected functional attribute and a second selected visual attribute; and at least one zone of a third zone type, the third zone being a transition zone disposed between the first and second zones, all the zones being formed as a unitary woven construct with adjacent zones seamlessly joined together, at least a portion of the third transition zone being adjacent and in between at least a portion of each of the first and the second zones; and wherein the transition zone comprises at least five different bands that progressively transition the selected first functional and visual attributes of the first zone to the second functional and visual attributes of the second zone based on the weft and/or warp yarns being selectively floated in a progressive band-to-band transition of the selected functional and visual attributes within the transition zone.

4. The end product of claim 3 wherein the selective float defines the progressive transition of attributes by (1) in a first portion of the transition zone proximate the first zone, preferential placement of weft yarns that are reflective of the first zone at the face of the fabric construct, and/or (2) in a second portion of the transition zone proximate the second zone, preferential placement of weft yarns reflective of the second zone at the face of the fabric construct.

5. The end product of claim 3 wherein in the fabric construct the selective floats comprise a Jacquard weaving configuration that represent a progressive transition of the attributes.

6. The end product of claim 5 wherein in the fabric construct grouped sets of the selective floats are provided in successive bands of the transition zone to define a plurality of discrete shapes, the discrete shapes collectively forming a pattern that represents the progressive change of at least the visual attributes across the transition zone.

7. The end product of claim 6 wherein in the successive bands each discrete shape serves as a pixel and, the progressively changing pattern comprising a change in pixel size, shape and/or spacing moving within and across the portions of the transition zone.

8. The end product of claim 1 wherein in the fabric construct the portion of the transition zone is configured with a progressive change in yarn denier to provide the progressive, smooth transition from first zone to the second zone.

9. An end product that includes a fabric construct, comprising:

a woven fabric of weft and warp yarns, the fabric having a plurality of zones comprising at least one zone of a first zone type representing a first selected attribute; at least one zone of a second zone type representing a second selected attribute; and at least one zone of a third zone type, the third zone being a transition zone disposed between the first and second zones, all the zones being formed as a unitary woven construct with adjacent zones seamlessly joined together, at least a portion of the third transition zone being adjacent and in between at least a portion of each of the first and the second zones; and wherein the portion of the transition zone comprises a plurality of bands of sets of weft and/or warp yarns that collectively provide a progressive and smooth transition of the selected zone-type attributes from the first zone, through the transition zone, to the second zone; and wherein the portion of the transition zone comprises a plurality of bands of sets of weft and/or warp yarns that collectively provide a progressive and smooth transition of the selected zone-type attributes from the first zone, through the transition zone, to the second zone wherein in the fabric construct the height of a given band in a transition zone is 0.001% to 20% or thereabout the height of the transition zone to provide for the progressive, smooth transition of the attributes.

10. The end product of claim 9 wherein in the fabric construct each zone has a width of at least 4 inches or thereabout.

11. The end product of claim 10, wherein in the fabric construct each zone has a height of at least 4 inches or thereabout.

12. The end product of claim 9, wherein in the fabric construct the relative height of the first zone and the second zone (first zone/second zone or second zone/first zone) is within 16% to 100% or thereabout of each other.

13. The end product of claim 1 wherein in the fabric construct the relative height of the transition zone to: (i) the first zone and/or (ii) the second zone is within 16% to 10,000% or thereabout of one another.

14. The end product of claim 1 further comprising in the fabric construct a fourth zone with a fourth zone type representing a selected attribute different from the first or second zone types, and at least a portion of a transition zone being adjacent the fourth zone that provides for a progressive, smooth transition for the fourth selected attribute from the fourth zone to another zone of a zone type different from the fourth zone, the portion of the transition zone being adjacent and between the fourth zone and the other zone.

15. The end product of claim 1 wherein in the fabric construct the selected attribute of the first zone type is relatively high elasticity and the selected attribute of the second zone type is relatively high durability, the first zone and second zones thereby differing in elasticity and durability.

16. The end product of claim 9 wherein the end product comprises an article of apparel or footwear, which comprises multiple layers of woven or nonwoven textile, one layer of which is the fabric construct and another layer of which is a waterproof breathable textile layer, the layers being coextensive, at least in part.

17. The end product of claim 5 wherein the end product in the fabric construct the first zone, second zone, and third transition zone correspond to selected areas of a user's body, at least two zones being of a different weave type.

18. The end product of claim 17 wherein end product comprises an article of apparel and in the fabric construct the first zone comprises a durability zone type that is disposed at a relatively high wear area comprising a shoulder, upper back, collar bone to upper chest, elbow, arm cuff, leg cuffs, pocket, zipper, buttocks and/or knee area, and the second zone comprises a relatively less durable and more elastic zone disposed at a body joint where the body flexes or bends.

19. The end product of claim 18 wherein in the fabric construct the second zone or fourth zone comprises a breathability zone type disposed at an area comprising a mid to lower chest, abdomen, mid to lower back, and/or armpit area.

20. The end product of claim 5, wherein in the fabric construct the portion of the transition zone disposed between the first and second and zones provides for progressive transition across the transition zone of a first zone type of elasticity to a second zone type of relative in elasticity, and the zones are transitioned via varying the proportion of yarns of an elastic yarn types across the bands in the portion of the transition zone.

21. The end product of claim 1 wherein the end product comprises an article of apparel and wherein in the fabric construct a given zone has a portion on a front side of the article of apparel and another portion on a backside of the article of apparel, the portions being adjacent each other and seamlessly woven together in the fabric construct.

22. The end product of claim 5 wherein in the fabric construct the Jacquard configuration comprises a progressive, smooth transition of a visual effect.

23. The end product of claim 1 herein wherein the fabric construct comprises a twill weave.

24. The end product of claim 18 wherein the tensile strength for the first zone type for durability is at least 10% stronger than that of the second zone.

25. The end product of claim 18 wherein the tear strength of the first zone type for durability is at least 10% stronger than that of the second zone.

26. A method of making an end product selected from the group of an article of: footwear, apparel, tent, backpack, and luggage item; at least a portion of the article comprising a fabric construct, comprising:

weaving a fabric construct, comprising the steps of:

providing a set of warp yarns on a weaving apparatus and weaving a set of weft yarns into the warp yarns to produce a woven zone of a first zone type representing a first selected attribute;

providing a second set of weft yarns on the apparatus and weaving the second set of weft yarns into the warp yarns to produce a woven zone of a second zone type representing a second selected attribute;

providing a third set of weft yarns on the apparatus and weaving the third set of weft yarns into the warp yarns to produce a woven zone of a third zone type, the third zone being a transition zone disposed between the first and second zones, all the zones being formed as a unitary woven construct, with the adjacent zones seamlessly joined together, at least a portion of the third transition zone being adjacent and in between at least a portion of each of the first and the second zone, the transition zone providing a progressive and smooth transition from the first selected attribute type to the second selected attribute type; and wherein the portion of the transition zone comprises a plurality of bands of sets of weft and/or warp yarns that collectively provide a progressive transition of the properties of the first selected attribute for the first zone type to the properties of the second selected attribute for the second zone type; and mapping a pattern for the article onto the fabric construct, the pattern providing a singular, flat cutout wherein adjacent portions of certain of the zones can be cut into a unitary structure and then folded to align edges to form a three-dimensional shape for the article wherein one of the adjacent portions becomes disposed on a front side of the unitary structure and the other becomes disposed on a back side of the unitary structure.

27. The method of claim 26 further comprising cutting the pattern and joining the edges to form the shape of the article.

28. The method of any of claim 26 wherein the method comprises weaving using a Dobby weaving machine.

29. An article of apparel or footwear, comprising:

a fabric construct, comprising:

a unitary woven fabric of weft and warp yarns, the fabric having a perimeter bounding a plurality of zones comprising at least one zone of a first zone type representing a first selected attribute, and at least one zone of a second zone type, the second zone being a transition zone having at least a portion disposed adjacent the first zone, both zones being seamlessly joined together in the unitary woven fabric; and wherein the transition zone comprises a plurality of bands of sets of weft and/or warp yarns that collectively provide a progressive and smooth transition for the selected first attribute from the first zone through the transition zone; and wherein the transition zone is isolated in a section of the fabric that is spaced away from the fabric's perimeter and does not extend from an edge to an edge of the fabric.

30. The fabric construct of claim 1, wherein the first zone is isolated in a section of the fabric that is spaced away from the fabric's perimeter and does not extend from an edge to an edge of the fabric.

31. The fabric construct of claim 1, wherein the fabric comprises a multiple layer construction selected from the group of double cloth, double weave, and double-faced constructs.

32. The fabric construct of claim 29, wherein the first zone of the fabric comprises a multiple layer construction selected from the group of double cloth, double weave, and double-faced constructs.

33. An end product that includes a fabric construct, comprising:

a woven fabric of weft and warp yarns, the fabric having a plurality of zones comprising at least one zone of a first zone type representing a first selected attribute; at least one zone of a second zone type representing a second selected attribute; and at least one zone of a third zone type, the third zone being a transition zone disposed between the first and second zones, all the zones being formed as a unitary woven construct with adjacent zones seamlessly joined together, at least a portion of the third transition zone being adjacent and in between at least a portion of each of the first and the second zones; and wherein the portion of the transition zone comprises a plurality of bands of sets of weft and/or warp yarns that collectively provide a progressive and smooth transition of the selected zone-type attributes from the first zone, through the transition zone, to the second zone; and wherein the first zone type of the fabric comprises a cut pile weave having a nap surface.

34. The end product of claim 9 wherein the article comprises a tent.

35. The tent of claim 34 wherein the first selected attribute is breathability, the second zone type having relatively less breathability.

36. The tent of claim 35 wherein the second selected attribute comprises a visual attribute for a color or shading that is darker than the color or shading for the first zone type.

37. The tent of claim 36 wherein the first zone type further represents a third selected attribute of durability, the durability of the first zone type being relatively less than the durability of the second zone type.

38. The article of apparel or footwear of claim 29 wherein in the fabric construct an attribute of the first zone type is elasticity and the second, transition zone progressively and smoothly transitions from the attribute of elasticity to a second selected attribute of durability.

39. The article of apparel or footwear of claim 29 wherein in the fabric construct the weft and/or warp yarns are selectively floated in a progressive transition within the portion of the second, transition zone to create different functional and/or visual effects across the transition zone so that the selective floats define the progressive transition of attributes at least in part, and wherein in the fabric construct, the selective floats comprise a Jacquard weaving configuration that defines the progressive, smooth transition of the attributes as variations in a given weave type.

40. The article of claim 39 wherein in the fabric construct the selective floats define a pattern of discrete shapes within the portion of the transition zone, the pattern progressively changing within and across the transition zone and representing the progressive transition of the attributes, at least in part.

41. The article of claim 40 wherein in the fabric construct the pattern comprises a progressively and smoothly changing pixelated pattern within the portion of the transition zone, the change comprising a change in pixel size, shape and/or spacing moving within and across the portion of the transition zone, the pixels being represented by the selective floats in the uniform weave type.

* * * * *